US008940108B2

(12) United States Patent
Stutchbury

(10) Patent No.: US 8,940,108 B2
(45) Date of Patent: Jan. 27, 2015

(54) CONDUIT CLEANING APPARATUS

(75) Inventor: Neil Stutchbury, East Boldon (GB)

(73) Assignee: Hydrascan Limited, Gateshead, Tyne and Wear (GB)

( * ) Notice: Subject to any disclaimer, the term of this patent is extended or adjusted under 35 U.S.C. 154(b) by 794 days.

(21) Appl. No.: 12/991,530

(22) PCT Filed: May 6, 2009

(86) PCT No.: PCT/GB2009/050468

§ 371 (c)(1),
(2), (4) Date: Nov. 8, 2010

(87) PCT Pub. No.: WO2009/136192

PCT Pub. Date: Nov. 12, 2009

(65) Prior Publication Data

US 2011/0048559 A1 Mar. 3, 2011

(30) Foreign Application Priority Data

May 7, 2008 (GB) ..... 0808208.3
May 7, 2008 (GB) ..... 0808210.9

(51) Int. Cl.

| | |
|---|---|
| ***B08B 9/053*** | (2006.01) |
| ***B08B 9/043*** | (2006.01) |
| ***B08B 3/02*** | (2006.01) |
| ***B08B 3/04*** | (2006.01) |

(Continued)

(52) U.S. Cl.

CPC ..... *B08B 9/0433* (2013.01); *B08B 3/02* (2013.01); *B08B 3/022* (2013.01); *B08B 3/024* (2013.01); *B08B 3/04* (2013.01); *B08B 3/041* (2013.01); *B08B 9/027* (2013.01); *B08B 9/0495* (2013.01); *B08B 9/0551* (2013.01)

USPC ..... 134/168 C; 134/166 C; 134/198; 137/625.48

(58) Field of Classification Search

USPC ..... 134/56 R, 166 C, 168 C, 198; 137/240, 137/899, 625.48

See application file for complete search history.

(56) References Cited

U.S. PATENT DOCUMENTS

| | | | | |
|---|---|---|---|---|
| 1,587,194 | A | 7/1925 | Sladden | |
| 3,321,184 | A * | 5/1967 | Goss | 254/134.4 |

(Continued)

FOREIGN PATENT DOCUMENTS

| | | |
|---|---|---|
| DE | 19516780 C1 | 8/1996 |
| DE | 19620783 A1 | 5/1997 |

OTHER PUBLICATIONS

International Search Report in counterpart foreign Application No. PCT/GB2009/050468.

*Primary Examiner* — Kevin Murphy
(74) *Attorney, Agent, or Firm* — Arthur Jacob

(57) ABSTRACT

An apparatus (1) for controlling the flow of fluid in a conduit comprises a main body (2) including a bore, having a first open end (3) and a second end (5), a fluid inlet for coupling said first open end (3) of said main body to a source of fluid, a fluid outlet (19) adapted to direct at least a portion of the fluid entering via the fluid inlet in a direction so as to propel the apparatus through the interior of the conduit. The apparatus comprises a control element (15) movable between (a) a first position in which at least one fluid path exists between at least one said fluid inlet and at least one said first fluid outlet (19); and (b) a second position in which at least one fluid path exists between at least one said fluid inlet and at least one said second fluid outlet (17). The fluid paths formed comprise at least one curvilinear portion.

1 Claim, 21 Drawing Sheets

(51) Int. Cl.

| | |
|---|---|
| ***B08B 9/027*** | (2006.01) |
| ***B08B 9/049*** | (2006.01) |
| ***B08B 9/055*** | (2006.01) |

(56) References Cited

U.S. PATENT DOCUMENTS

| | | | | | |
|---|---|---|---|---|---|
| 3,635,230 | A | * | 1/1972 | Kirschke | 134/168 C |
| 4,699,163 | A | * | 10/1987 | Baziuk | 134/167 C |
| 5,580,393 | A | * | 12/1996 | Lawther | 134/8 |
| 5,720,309 | A | * | 2/1998 | Baziuk | 134/167 C |
| 5,814,162 | A | * | 9/1998 | Barrett et al. | 134/22.12 |
| 5,862,561 | A | * | 1/1999 | Irwin | 15/104.33 |
| 5,875,803 | A | * | 3/1999 | Leitko et al. | 134/167 C |
| 6,089,243 | A | * | 7/2000 | Horger et al. | 134/167 C |
| 6,394,112 | B1 | * | 5/2002 | Steinmetz et al. | 134/167 C |
| 6,615,848 | B2 | * | 9/2003 | Coats | 134/22.11 |
| 7,159,600 | B2 | * | 1/2007 | MacNeil et al. | 134/199 |
| 2002/0162406 | A1 | * | 11/2002 | Wentworth et al. | 73/865.8 |

* cited by examiner

CONDUIT CLEANING APPARATUS

The present invention relates to an apparatus for cleaning the interior of a conduit. Although the present invention has applications in numerous areas of technology, the present application is particularly, but not exclusively suitable for use with water pipes of various cross sectional sizes, and other types of underground conduit such as sewerage pipes.

It is known to use a pipe cleaning apparatus employing cleaning water jets, which supply water at high pressure to the interior of a pipe, to remove debris from the interior of the pipe. Such apparatuses are typically propelled through the interior of the pipe using propulsion water jets in order to propel the apparatus through the interior of the pipe on its outbound journey.

Although such known apparatuses provide a useful means of cleaning the interior of a pipe, they suffer from several disadvantages. For example, a large volume of water is typically used as a result of the provision of the cleaning water jets and the propulsion water jets. This can result in the interior of the pipe becoming heavily logged with water from the jets, which can be time consuming and expensive to remove.

An aim of the present invention is to provide an apparatus for cleaning the interior of a conduit, which overcomes or at least alleviates the problems associated with known conduit cleaning apparatuses.

In accordance with a first aspect of the present invention there is provided an apparatus for controlling the flow of fluid in a conduit, the apparatus comprising:

(i) at least one main body including a bore, having a first open end and a second end;

(ii) at least one fluid inlet for coupling said first open end of at least one said main body to a source of fluid;

(iii) at least one first fluid outlet adapted to direct at least a portion of the fluid entering via at least one said fluid inlet in a first direction; and (iv) at least one second fluid outlet adapted to direct at least a portion of the fluid entering via at least one said fluid inlet in a direction so as to propel the apparatus through the interior of said conduit, said apparatus being characterised in that it comprises a control element movable between (a) a first position in which at least one fluid path exists between at least one said fluid inlet and at least one said first fluid outlet; and (b) a second position in which at least one fluid path exists between at least one said fluid inlet and at least one said second fluid outlet.

Preferably, no fluid path exists between at least one said fluid inlet and at least one said second fluid outlet when said control element is in its first position, and no fluid path exists between at least one said fluid inlet and at least one said first fluid outlet when said control element is in its second position.

This provides the advantage that the apparatus can be propelled along on its outbound journey deep into the interior of the conduit with the cleaning fluid stream switched off and the propulsion fluid stream (via the second fluid outlet) switched on, and then pulled back on its inbound journey (using a winching device for example) with the cleaning fluid stream (via the first fluid outlet) switched on and the propulsion fluid stream switched off. In particular, the control element can be moved between its first and second positions to selectively activate the first and second fluid outlets respectively, when required. This in turn provides the advantage that the cleaning fluid stream is not active on the outbound journey deep into the interior of the conduit and is instead only active on the inbound journey. Similarly, the propulsion fluid stream is active on the outbound journey deep into the interior of the conduit and is not active on the inbound journey.

In this way, the total volume of fluid, such as water, that is utilised in the cleaning process as a whole is significantly reduced, whilst still providing the necessary cleaning action. This reduces costs both in the volume of water used during the cleaning process, the time required to remove residual water from the conduit, and the costs associated with the disposal of contaminated water.

Preferably, at least one said first fluid outlet and at least one said second fluid outlet form a part of at least one said main body and at least one said control element is disposed within said bore and is rotatable between said first and second positions about a longitudinal axis of said main body.

Preferably, at least one said main body comprises a plurality of first fluid outlets adapted to direct at least a portion of the fluid entering via at least one said fluid inlet towards an interior surface of said conduit, and a plurality of second fluid outlets adapted to direct at least a portion of the fluid entering via at least one said fluid in a direction so as to propel the apparatus through the interior of said conduit.

Alternatively, at least one said first fluid outlet and at least one said second fluid outlet are mounted upon at least one said control element and at least one said control element is rotatable between said first and second positions about a longitudinal axis of said main body.

Preferably, at least one said control element comprises a plurality of first fluid outlets adapted to direct at least a portion of the fluid entering via at least one said fluid inlet towards an interior surface of said conduit, and a plurality of second fluid outlets adapted to direct at least a portion of the fluid entering via at least one said fluid inlet in a direction so as to propel the apparatus through the interior of said conduit.

Alternatively, at least one said control element is movable between its first and second positions in a direction substantially parallel to direction of flow of fluid between said first and second ends of said main body.

In this case, it is preferable that at least one said first outlet is disposed adjacent said first end and is adapted to direct fluid in a direction substantially perpendicular to the longitudinal axis of said main body.

Further, in this case, it is preferable that at least one said second outlet is disposed adjacent said second end.

In this way, the cleaning fluid stream may be used to clean the interior of the conduit on the inbound journey of the apparatus, with the control element in its first position.

Preferably, at least one said second outlet is disposed adjacent said second end and is adapted to direct fluid in a direction substantially parallel to the direction of flow of fluid between said first and second ends of said main body and in an opposite direction to the flow of fluid as it travels between said first and second ends.

In this way, the propulsion fluid stream may be directed rearwardly in order to propel the apparatus through the interior of the conduit on its outbound journey, with the control element in its second position.

Alternatively, at least one said second outlet is disposed adjacent said second end and is adapted to direct fluid in a direction substantially parallel to the direction of flow of fluid between said first and second ends of said main body and in the same direction as the flow of fluid as it travels between said first and second ends.

At least one said first fluid outlet may include a first nozzle extending from an exterior wall of said main body.

Said first nozzle may be configured such that at least a portion of fluid entering the main body is directed at an angle of 90 degrees to the longitudinal axis of the main body.

Alternatively, said first nozzle may be configured such that at least a portion of fluid entering the main body including a bore is directed at an angle of 45 degrees to the longitudinal axis of the main body.

However, it is to be appreciated that the fluid could be directed at any suitable angle to the longitudinal axis of the main body.

At least one second fluid outlet may include a second nozzle extending from an exterior wall of said main body.

Preferably, a fluid path formed between at least one said fluid inlet and at least one said second fluid outlet, comprises at least one curvilinear portion.

This provides the advantage that the efficiency of the apparatus is improved in view of the fact that there are no sharp deflections to the flow of fluid through the apparatus, with the result that turbulence is reduced and the efficiency of the apparatus is improved. This provides the further advantage that the pressure drop of the fluid across the apparatus is significantly less than would otherwise be the case if the fluid path formed between at least one said fluid inlet and at least one said second fluid outlet included sharp bends (such as is the case in a transverse spool valve, for example).

Preferably, said control element is a collar disposed within said main body.

Preferably, said apparatus further comprises at least one actuator for moving the control element between said first and second positions.

Preferably, at least one said actuator comprises at least one actuator pin extending from said collar and extending through an aperture disposed on the main body.

Preferably, said apparatus further comprises an umbilical hose having a first end connected to said fluid inlet and a second end connectable to a pressurised fluid source.

Said apparatus may further comprise a digital camera coupled to a memory.

This provides the advantage that images of the interior of the conduit may be recorded as the apparatus travels through the interior of the conduit. In the case where the conduit is underground, this alleviates the need for personnel at ground level to inspect the interior of the conduit in real time to check for faults, thereby allowing for the apparatus to be propelled more quickly through the interior of the conduit. This provides the further advantage that trailing cables connecting the apparatus to monitoring equipment at ground level, are not required. This provides the further advantage that the interior of the conduit may be inspected on the outbound journey of the apparatus (that is, when the propulsion fluid stream is switched on and the cleaning fluid stream is switched off).

Said digital camera may be mounted on said main body and may be adapted so that it is able to move around the periphery of the main body.

Alternatively, said digital camera may be mounted on the longitudinal axis of said main body and may comprise a fish eye lens.

Said apparatus may further comprise a power supply.

In accordance with a second aspect of the present invention there is provided a vehicle comprising an apparatus as previously described, said vehicle comprising a means for reducing friction between the vehicle and the interior of a conduit.

This provides the advantage that the main body can be utilised in various types and sizes of conduit, by means of mounting the main body on different types and sizes of vehicle.

Said vehicle may comprise a main vehicle body and at least one manifold mounted to said main vehicle body, at least one said manifold comprising at least one manifold fluid inlet and at least one manifold fluid outlet, such that a fluid path exists between at least one said manifold fluid inlet and at least one said manifold fluid outlet, wherein said first nozzle is operatively connected to at least one said manifold fluid inlet.

Preferably, at least one said manifold comprises a single manifold fluid inlet and a plurality of manifold fluid outlets.

This provides the advantage that an improved cleaning action is provided.

Preferably, said vehicle comprises a plurality of manifolds disposed around the periphery of said vehicle.

At least one said manifold may be adjustable such that at least a portion of fluid entering the main body is able to be directed at various angles relative to the longitudinal axis of the main body.

Said vehicle may further comprise a control system for selectively adjusting at least one said manifold.

Alternatively, the manifold may be manually adjustable.

Said vehicle may further comprise a means for removing fluid from the interior of a conduit.

For example, said vehicle may comprise a pump which is able to pump water from the interior of the conduit to ground level, for disposal or recycling.

Said memory may be mounted on said main body.

In accordance with a third aspect of the present invention, there is provided an apparatus for controlling the flow of fluid in a conduit, the apparatus comprising:

(i) at least one main body including a bore, having a first open end and a second end;

(ii) at least one fluid inlet for coupling said first open end of at least one said main body to a source of fluid;

(iii) at least one fluid outlet adapted to direct at least a portion of the fluid entering via at least one said fluid inlet in a direction so as to propel the apparatus through the interior of said conduit, said apparatus being characterised in that a fluid path formed between at least one said fluid inlet and at least one said fluid outlet comprises at least one curvilinear portion.

Preferably, said apparatus further comprises at least one second fluid outlet adapted to direct at least a portion of the fluid entering via at least one said fluid inlet towards an interior surface of said conduit.

Preferred embodiments of the present invention will now be described, by way of example only and not in any limitative sense, with reference to the accompanying drawings in which.

Figure 3:
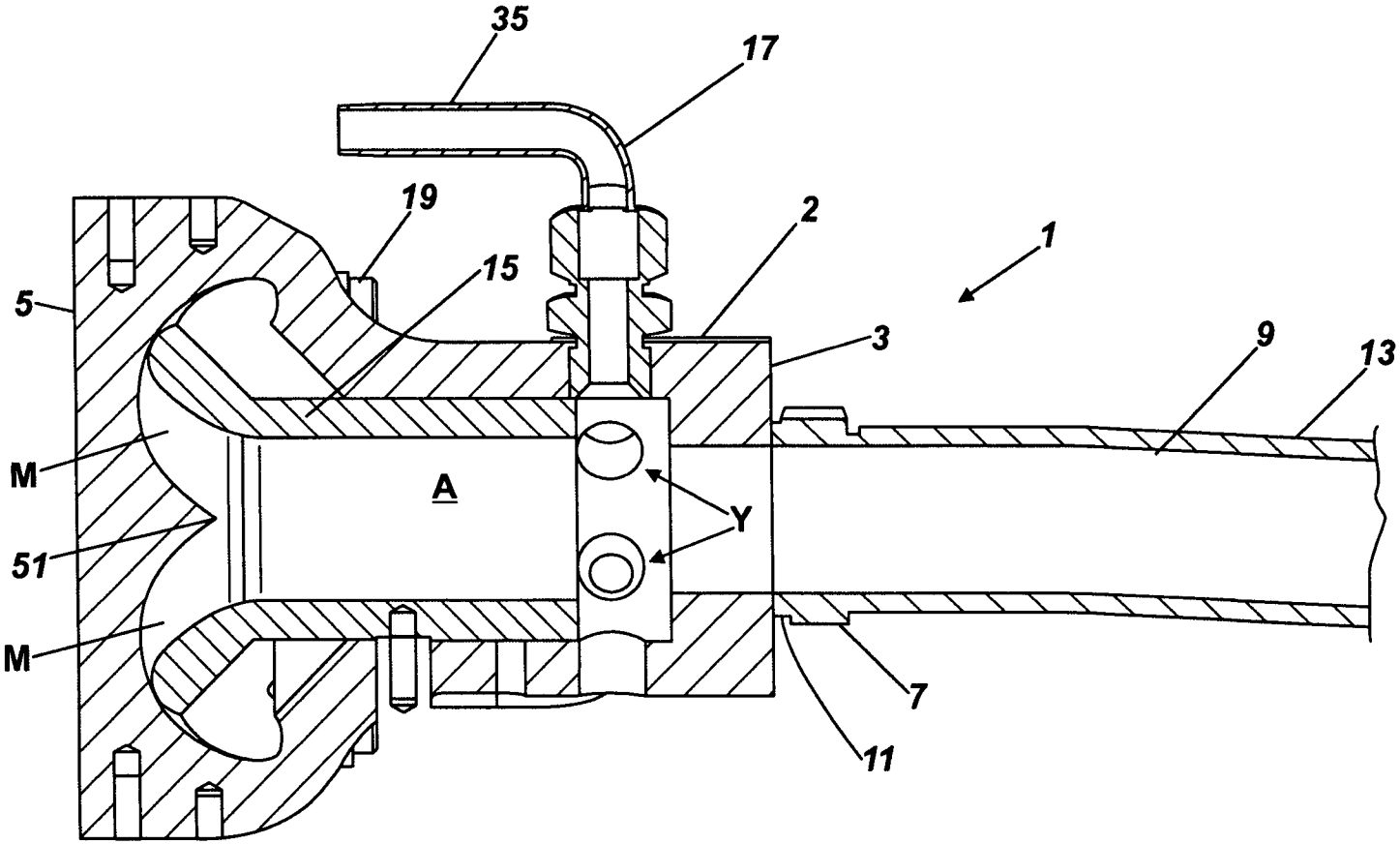
FIG. 3 shows a cross sectional view of a portion of an apparatus in accordance with a first embodiment of the present invention, with the control element in a first position.
Figure 3A:
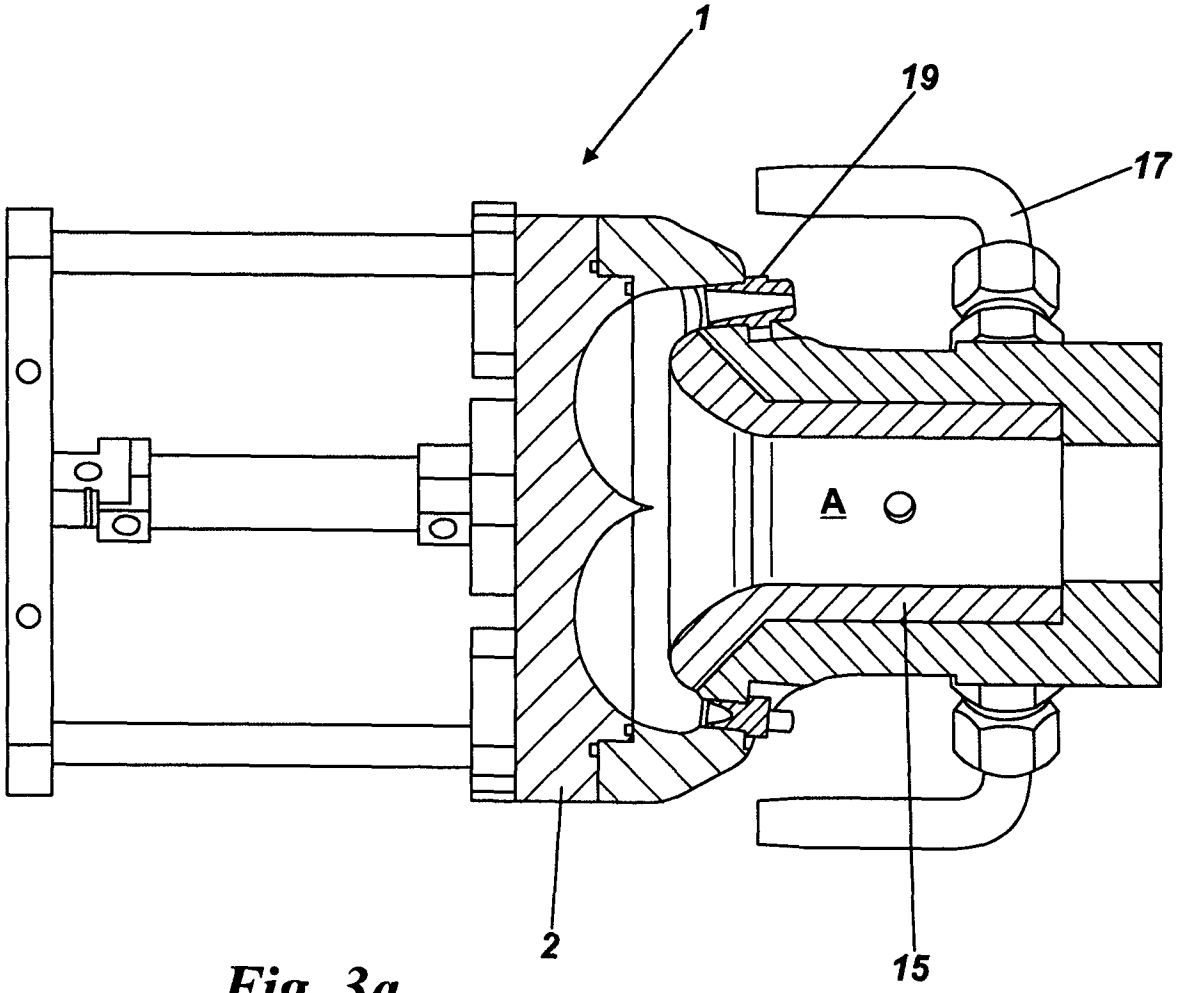
Figure 4:
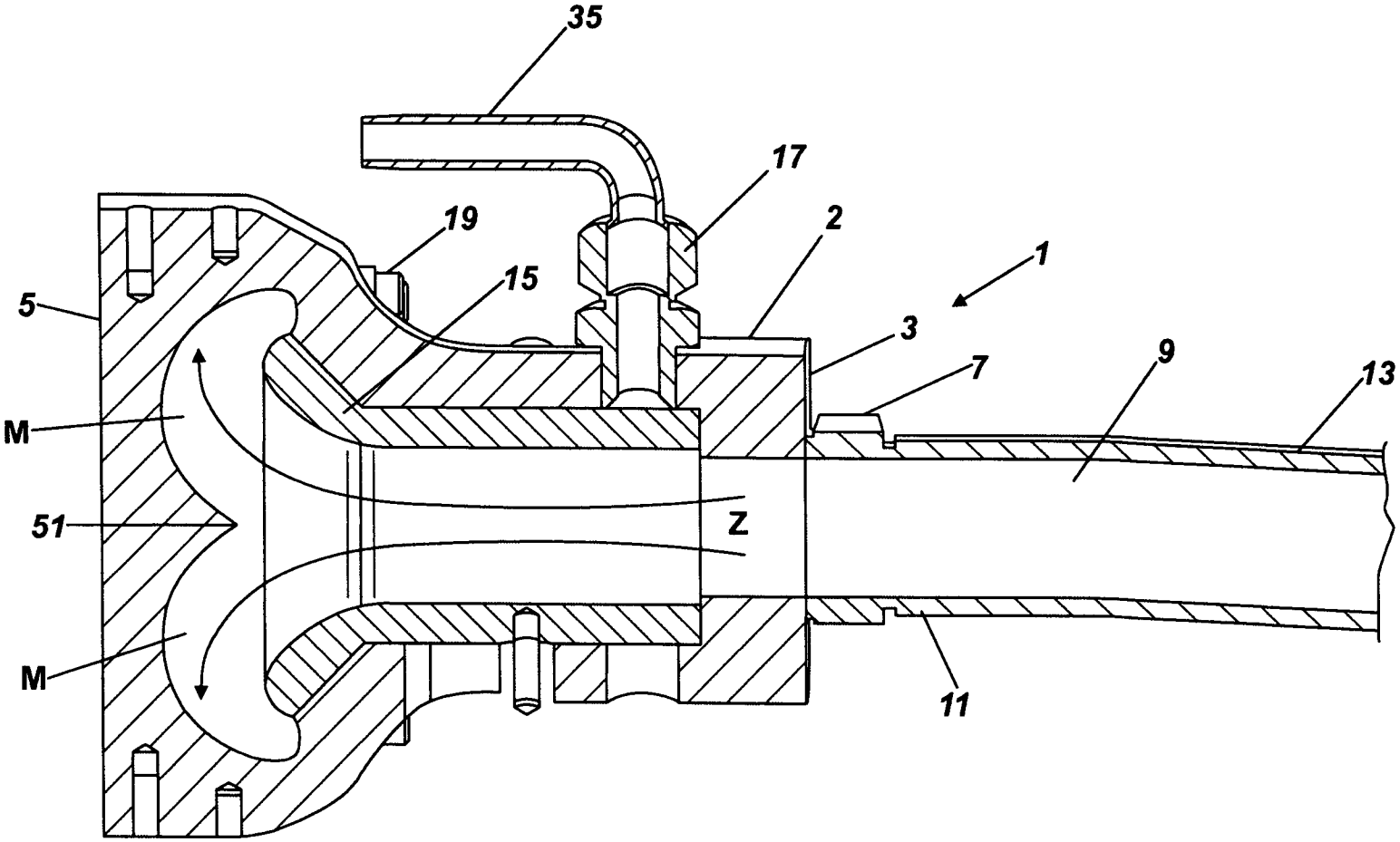
Figure 5:
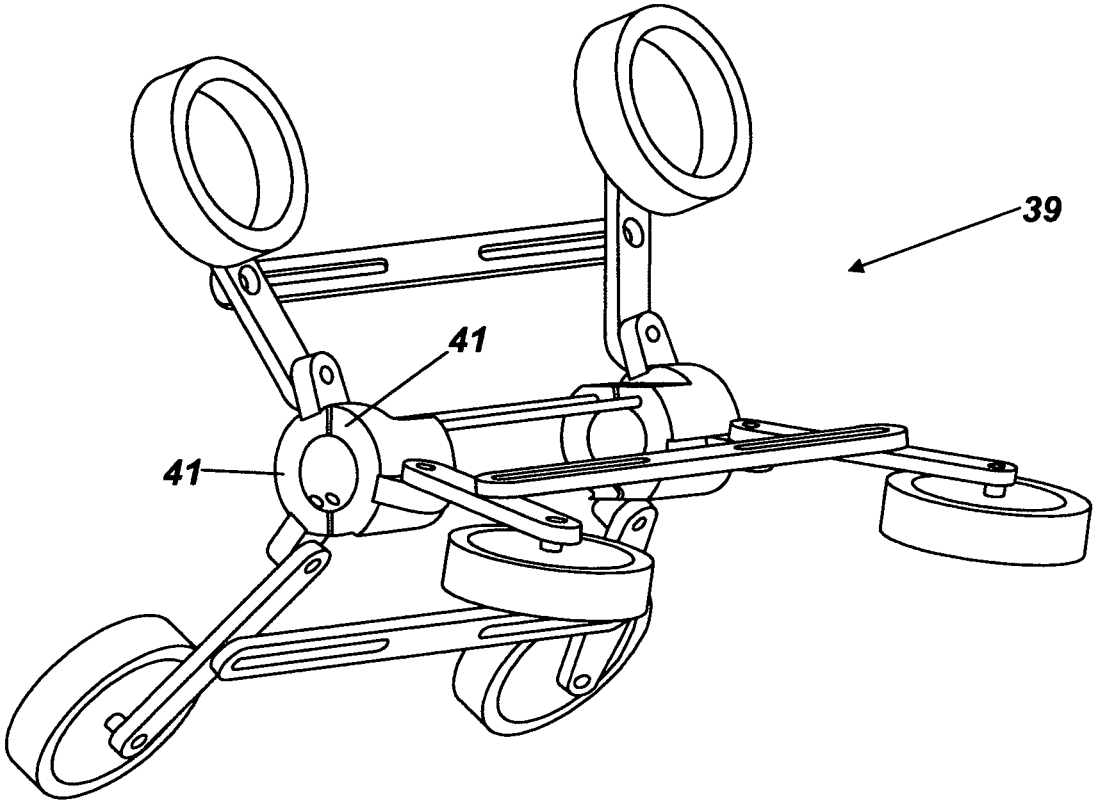
Figure 6:
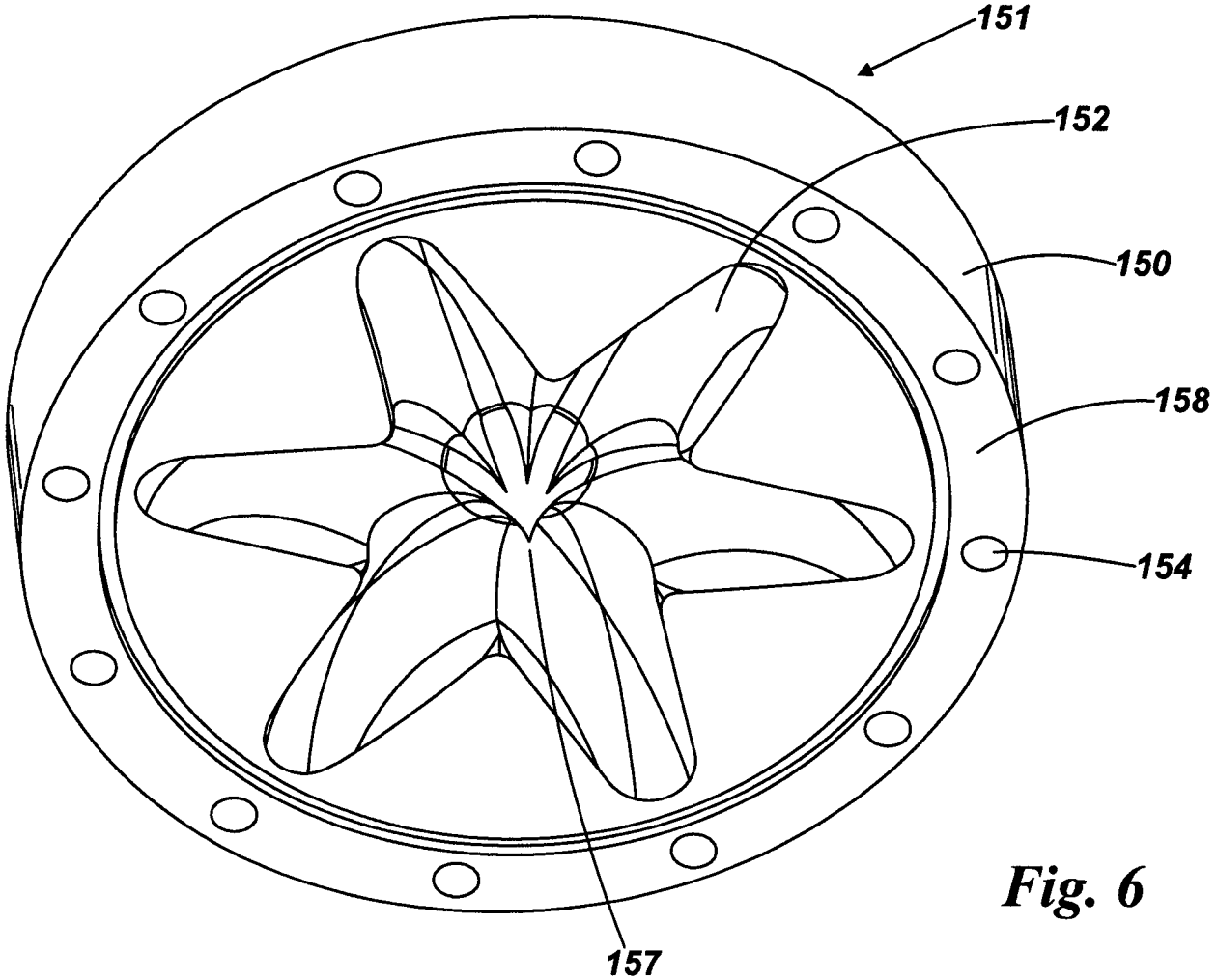
Figure 6A:
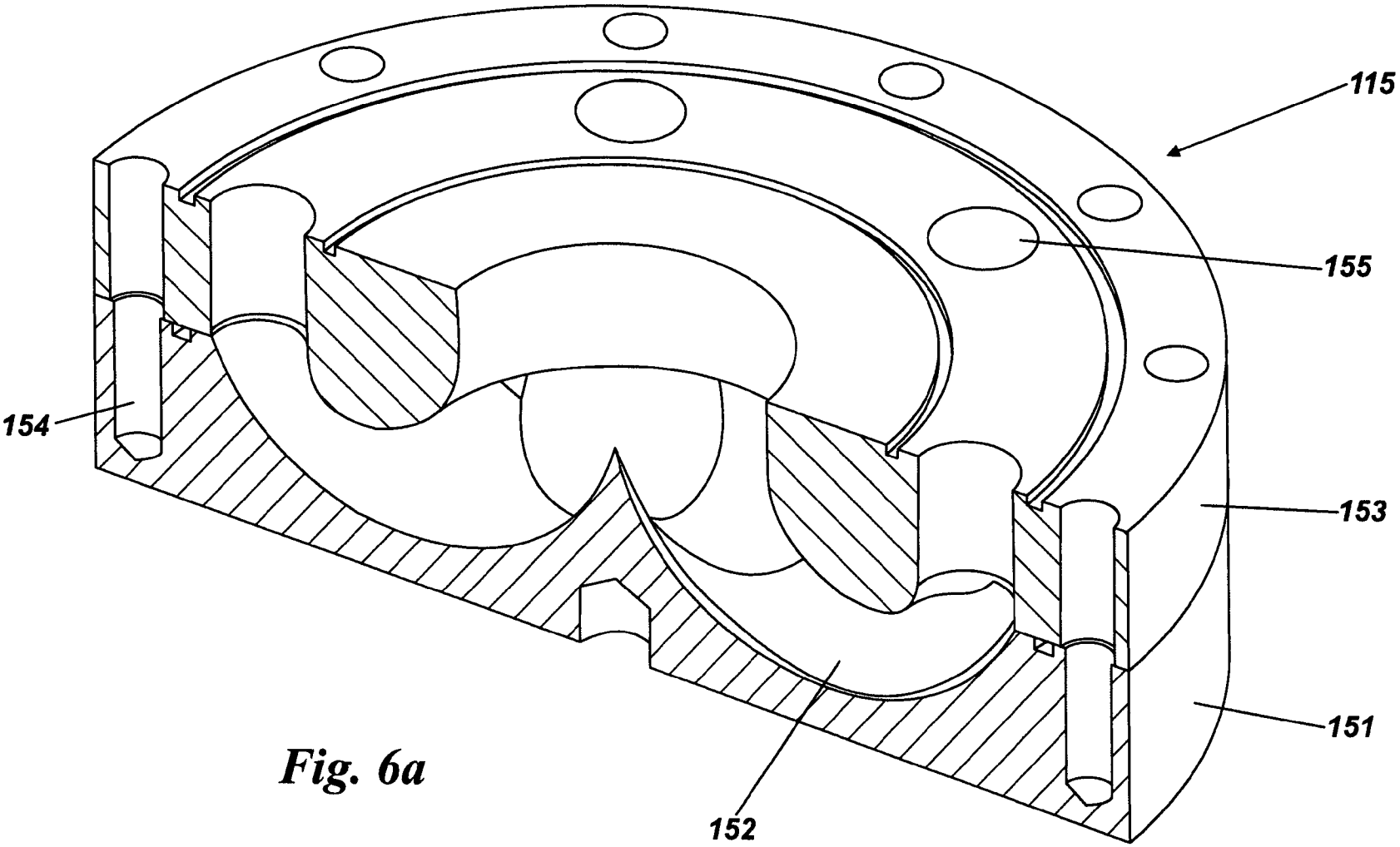
Figure 7:
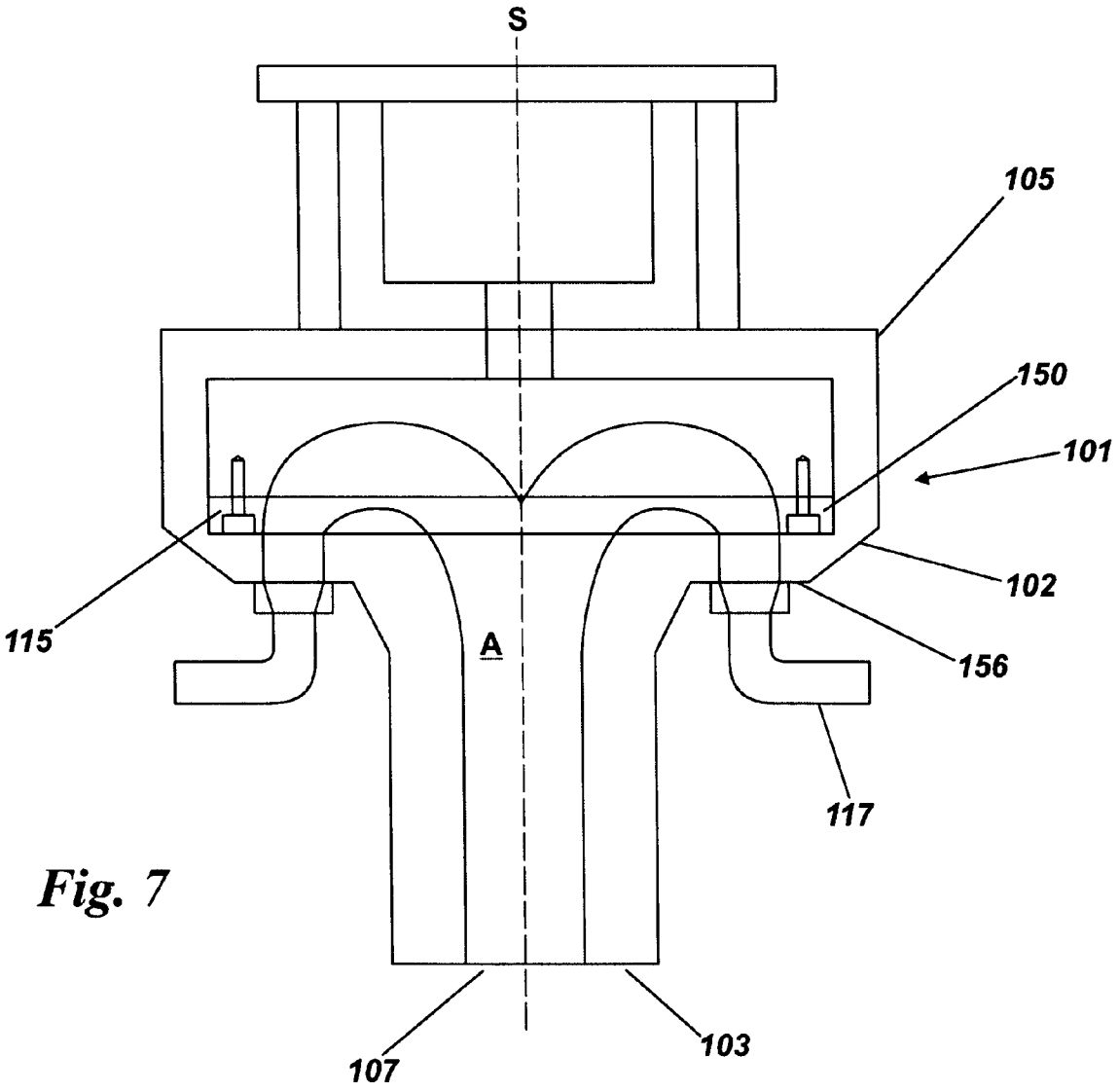
Figure 8:
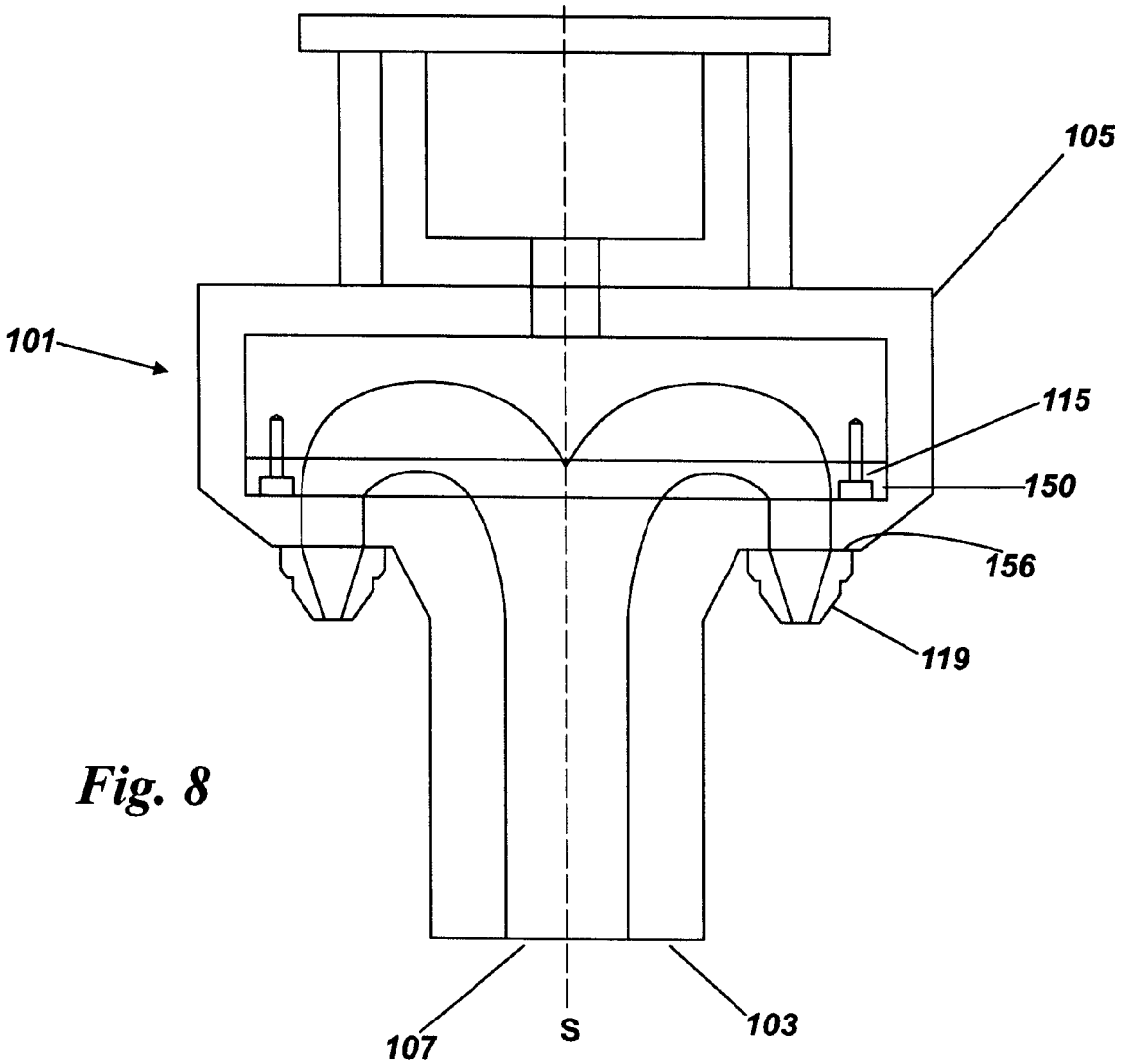
Figure 9:
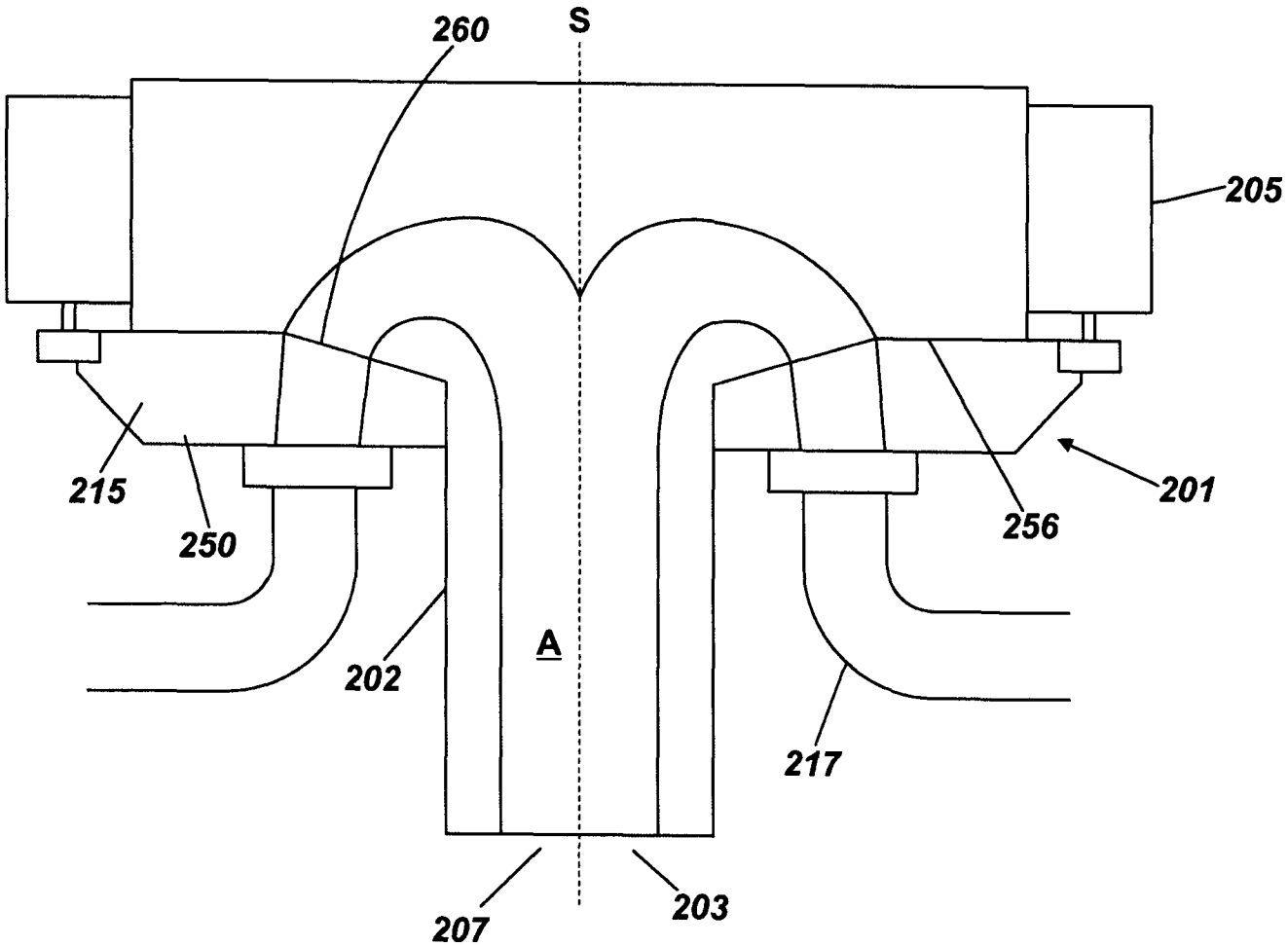
Figure 10:
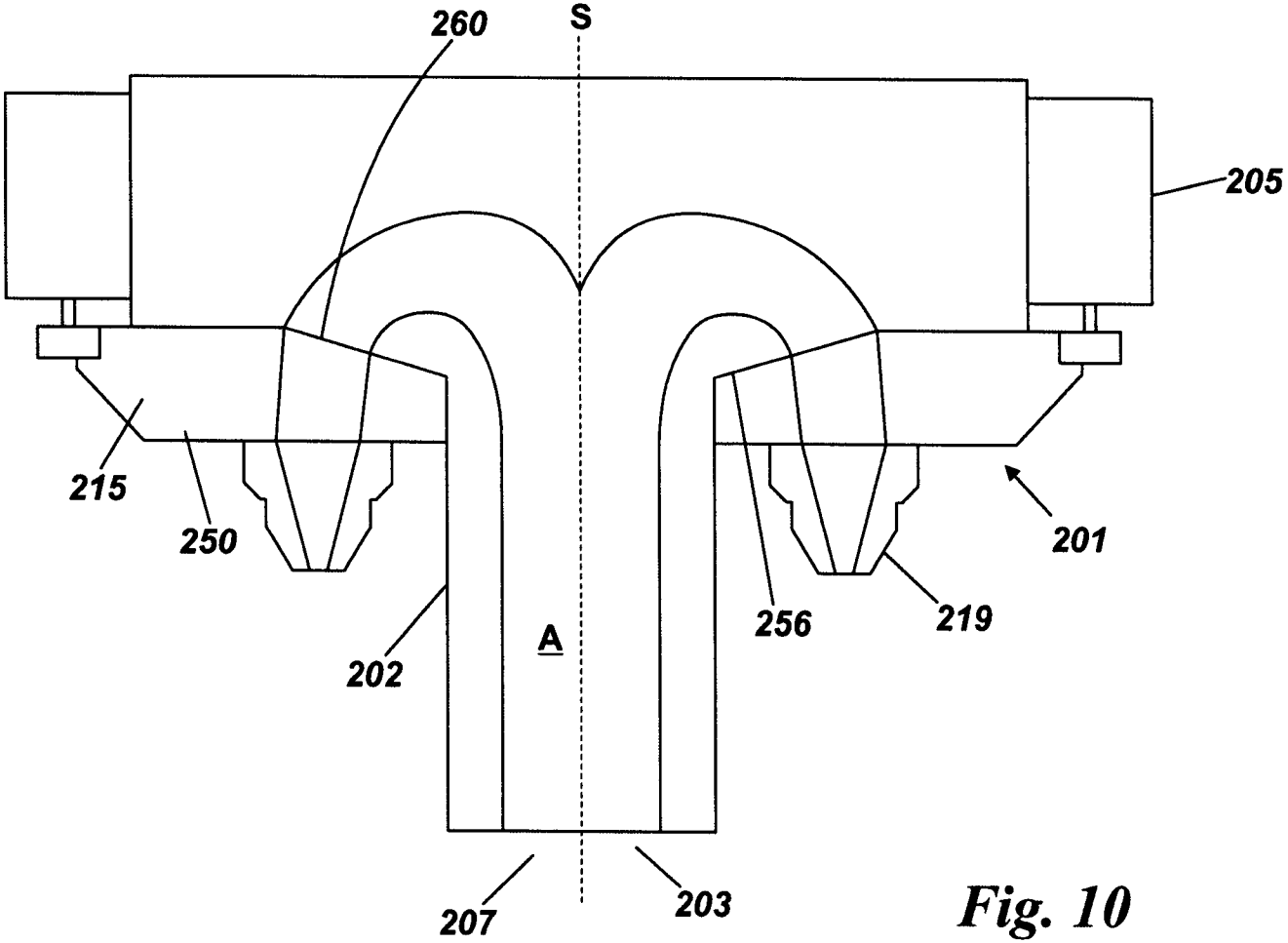
Figure 11:
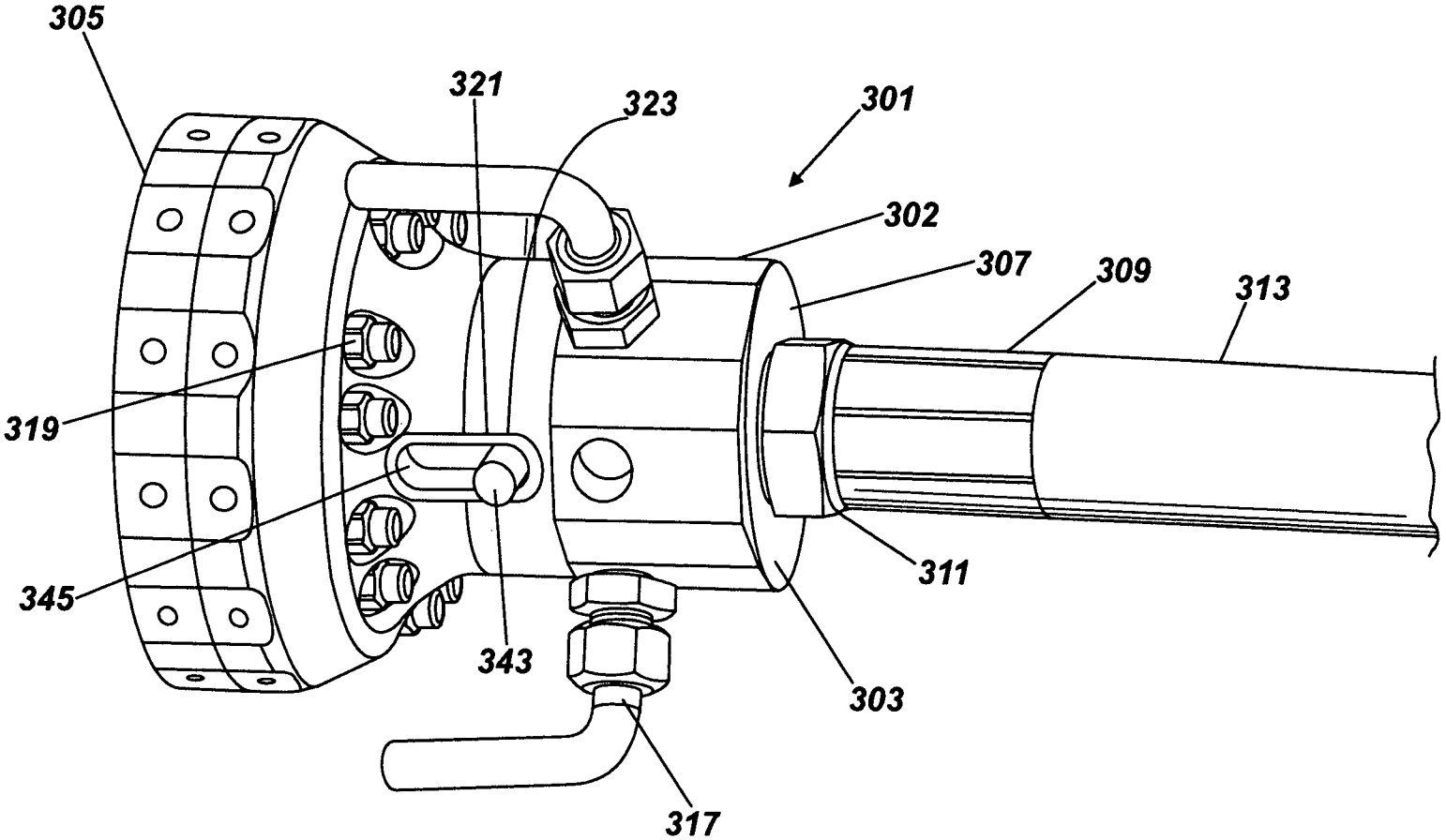
Figure 12:
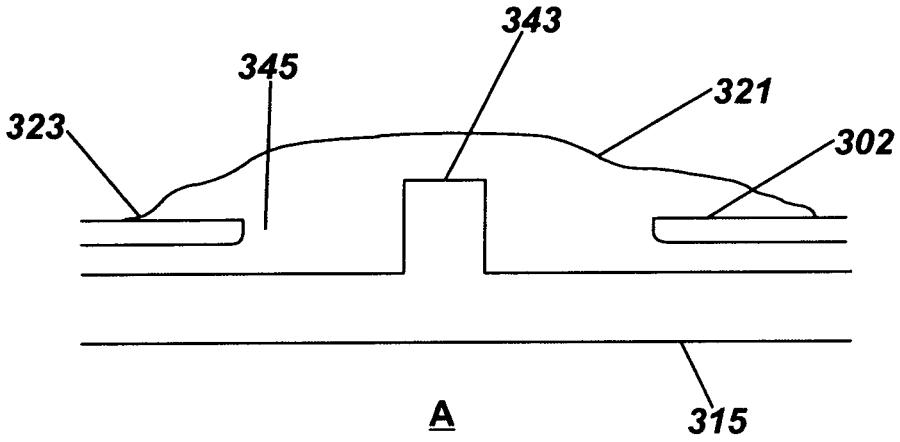
Figure 13:
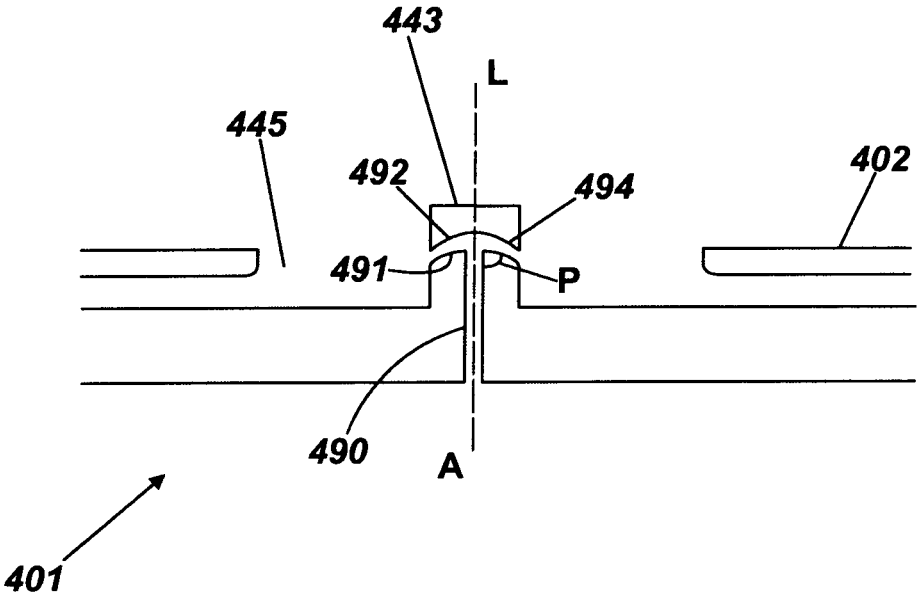
Figure 14:
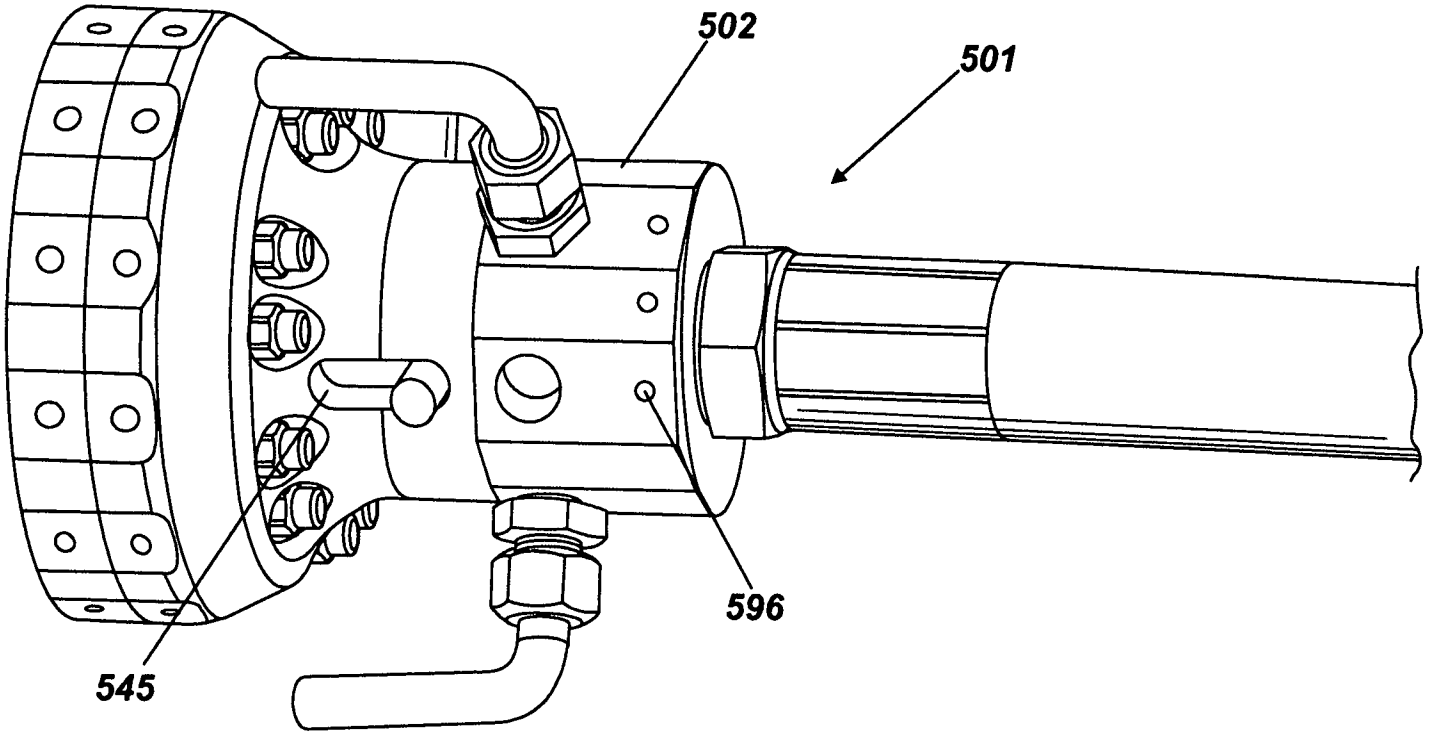
Figure 15:
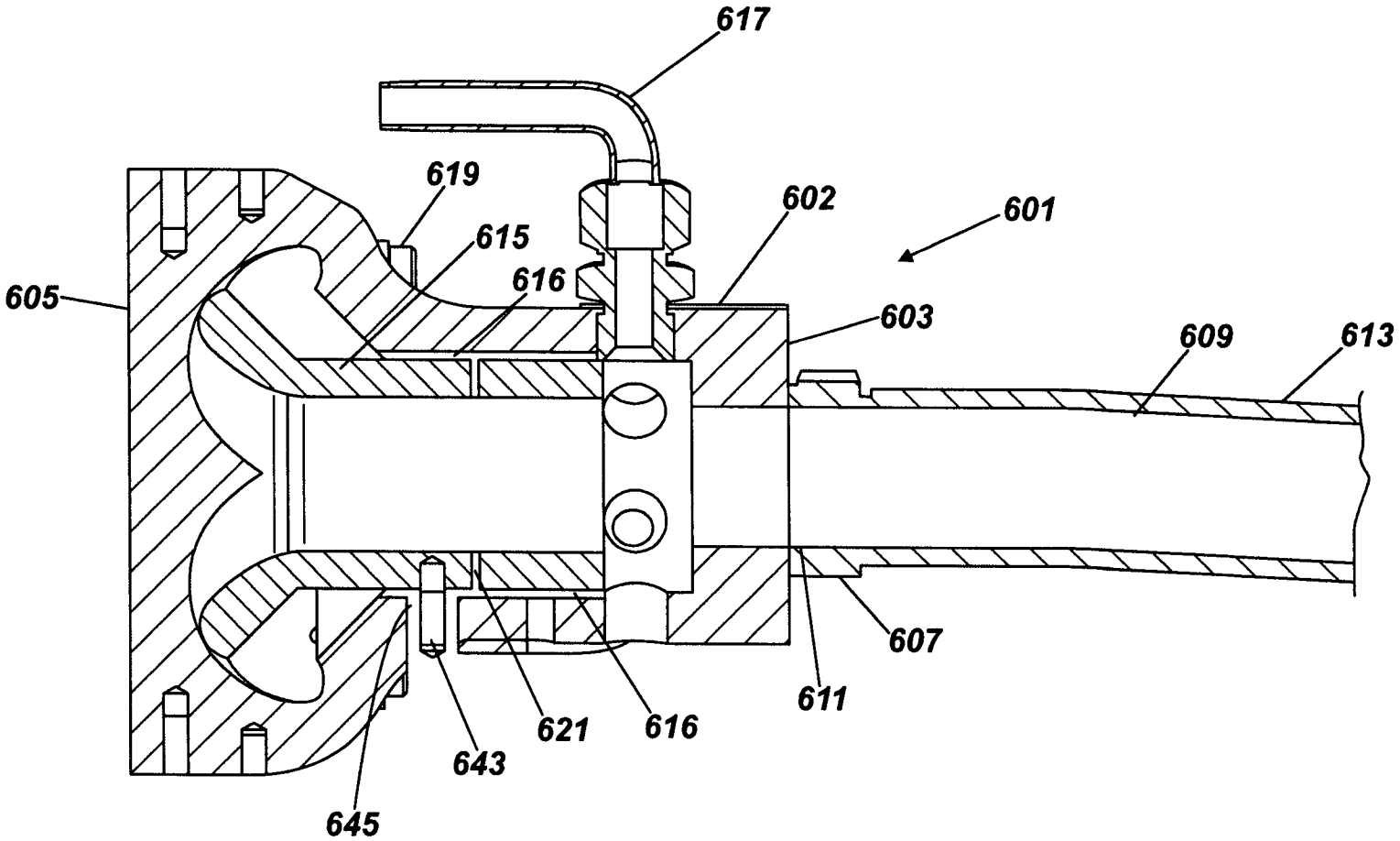
Figure 16:
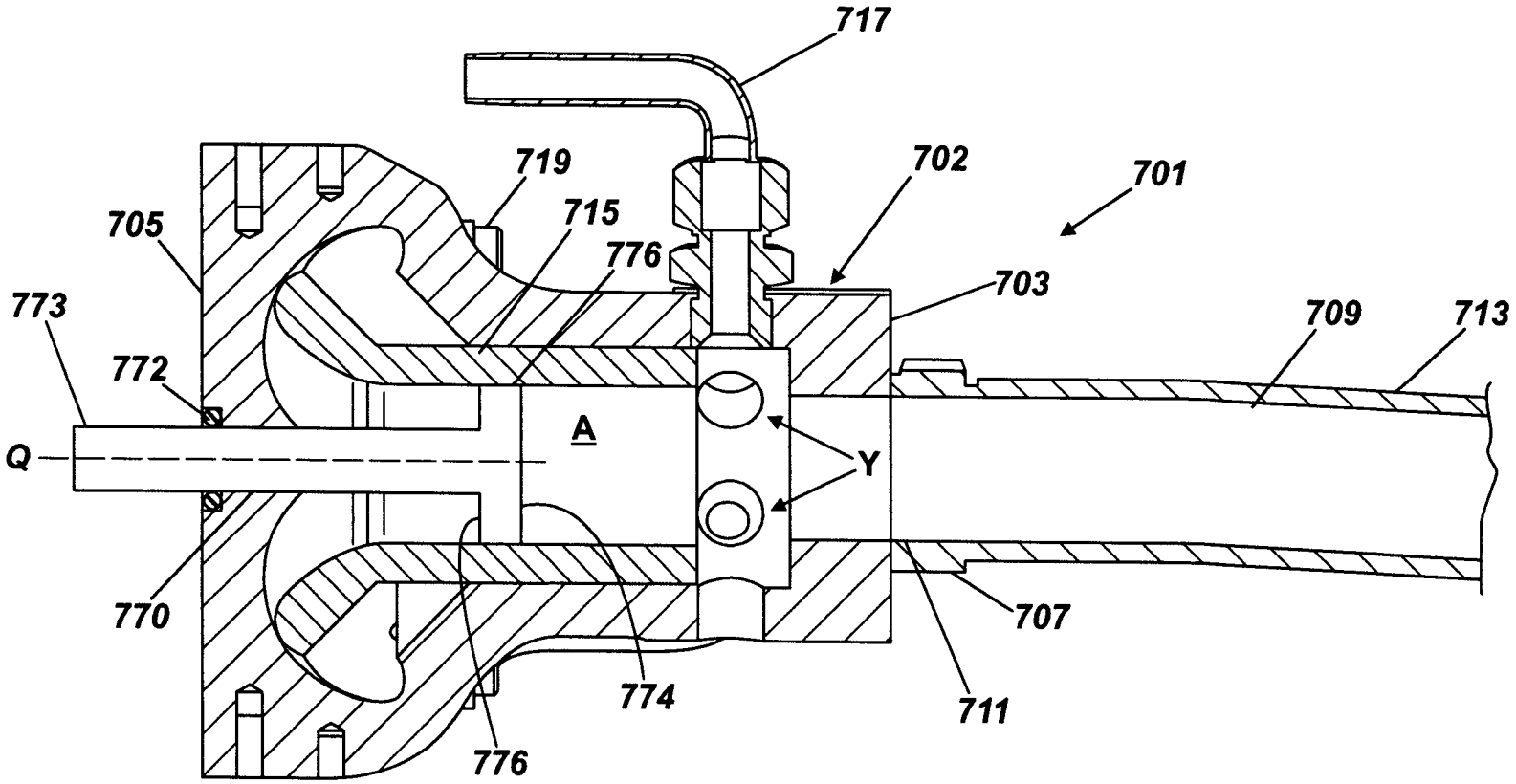
Figure 17:
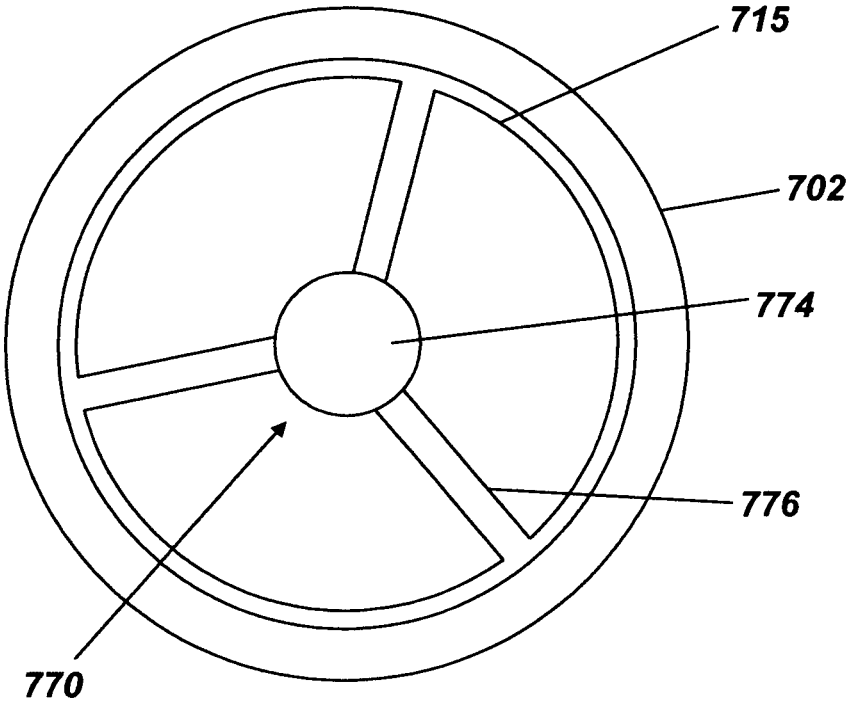
Figure 18:
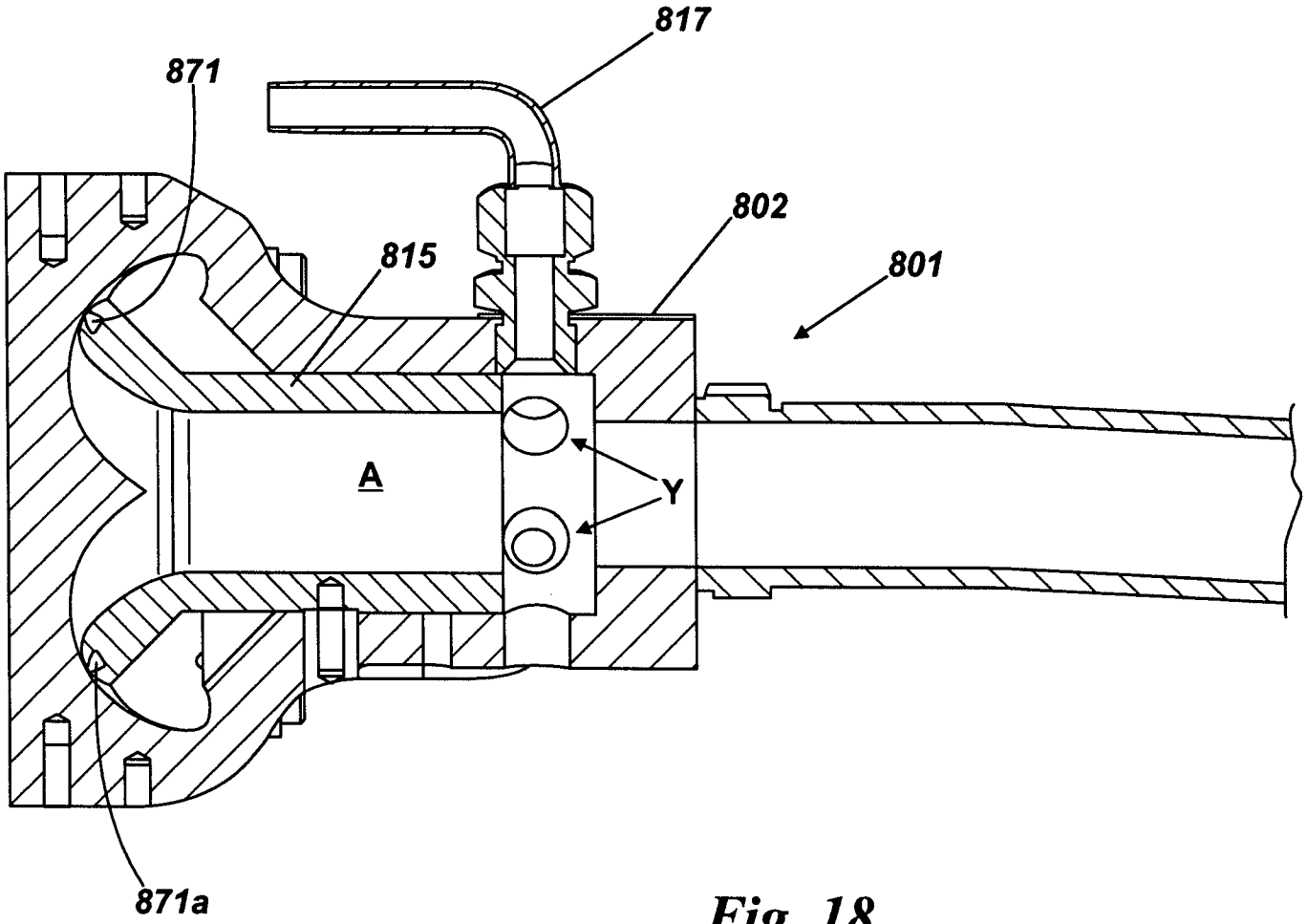
Figure 19:
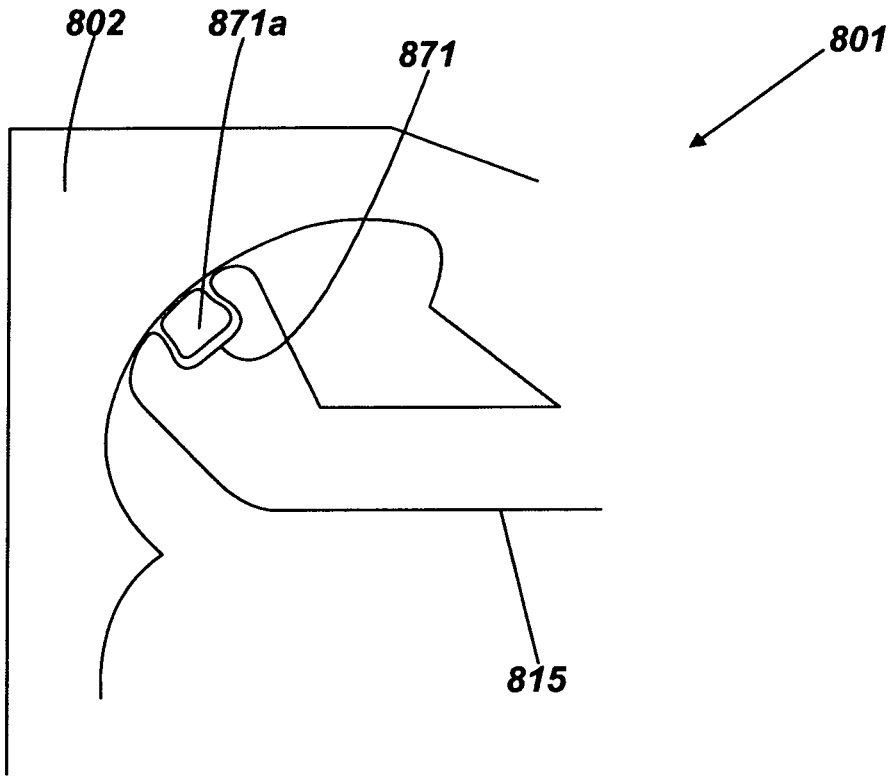

FIG. 3*a* shows a cross sectional view of a portion of the apparatus of FIG. 3 showing the propulsion nozzles in more detail;

FIG. 4 shows a cross sectional view of a portion of an apparatus in accordance with a first embodiment of the present invention, with the control element in a second position;

FIG. 5 shows a cross sectional view of a support device forming a part of an apparatus in accordance with the present invention;

FIG. 6 shows a perspective view of a portion of a control element forming a part of an apparatus in accordance with a second embodiment of the present invention;

FIG. 6*a* shows a cross sectional view of a control element forming a part of an apparatus in accordance with a second embodiment of the present invention;

FIG. 7 shows a cross-sectional view of a portion of an apparatus in accordance with a second embodiment of the present invention, with the control element in a first position;

FIG. 8 shows a cross sectional view of the apparatus of FIG. 7, with the control element in a second position;

FIG. 9 shows a cross-sectional view of a portion of an apparatus in accordance with a third embodiment of the present invention, with the control element in a first position;

FIG. 10 shows a cross-sectional view of the apparatus of FIG. 9, with the control element in a second position;

FIG. 11 shows a perspective view of a portion of an apparatus in accordance with a fourth embodiment of the present invention;

FIG. 12 shows a cross-sectional view of a portion of the apparatus of FIG. 11;

FIG. 13 shows a cross sectional view of a portion of an apparatus in accordance with a fifth embodiment of the present invention;

FIG. 14 shows a perspective view of an apparatus in accordance with a sixth embodiment of the present invention;

FIG. 15 shows a cross sectional view of a portion of an apparatus in accordance with a seventh embodiment of the present invention;

FIG. 16 shows a cross sectional view of a portion of an apparatus in accordance with an eighth embodiment of the present invention;

FIG. 17 shows an end view of an actuator shaft forming a portion of the apparatus of FIG. 16;

FIG. 18 shows a cross-sectional view of a portion of an apparatus in accordance with a ninth embodiment of the present invention; and FIG. 19 shows a cross-sectional view of a portion of the apparatus of FIG. 18.

Referring now to FIGS. 1 to 5, an apparatus for controlling the flow of fluid through the interior of a conduit is represented generally by reference numeral 1.

The apparatus 1 comprises a main body 2 including a bore in the form of a cavity A. The main body 2 has a first open end 3 and a second end 5, and it can be clearly seen from FIGS. 3, 3*a* and 4 in particular that cavity A is disposed between the first open end 3 and the second end 5. Further, a control element in the form of a collar 15 is disposed inside the cavity A. It is however, to be appreciated that the control element could take any suitable form. It can be seen from the Figures that fluid entering the main body 2 is able to travel through the cavity A.

The apparatus 1 further comprises a fluid inlet in the form of a coupling means 7 for coupling the first open end 3 to a source of fluid, for example, a water supply (not shown). The apparatus 1 further comprises an umbilical hose 9 which is connected at one end 11 to the coupling means 7 and at an opposite end 13 to the water supply.

The collar 15 comprises three actuator pins 43, each pin 43 extending through a corresponding aperture 45 in the main body 2, to facilitate the movement of the collar 15 between its first and second positions. It is to be appreciated that the presence of several pins 43 in this way as opposed to only a single pin 43 facilitates smoother actuation. It is envisaged that the collar 15 could be moved either by means of a fluid based system such as an air pressure operated system, an oil pressure operated system, or a water pressure operated system.

The apparatus 1 further comprises a circumferential seal (not shown) disposed between the collar 15 and the main body 2. The main body 2 also includes three first fluid outlets in the form of three take off cleaning nozzles 17 disposed around the periphery of the main body 2, and a plurality of second fluid outlets in the form of twelve propulsion nozzles 19 disposed around the periphery of the main body 2. As can be seen from FIG. 1 in particular, there are several "dead" areas 47 disposed around the periphery of the main body 2 where there are, for practical reasons, no propulsion nozzles 19. In order to further improve the thrust efficiency of the apparatus 1 and further reduce losses, the interior of the main body 2 in the region of these dead areas 47 are ridged in order to deflect the fluid in the main body 2 towards the propulsion nozzles 19.

In the absence of the collar 15, a first fluid path Y exists between the first open end 3 of the main body 2 and the cleaning nozzles 17, and a second fluid path Z exists between the first open end 3 of the main body 2 and the propulsion nozzles 19. In this way, when fluid enters the main body 2, it is able to pass out of either the cleaning nozzles 17 or the propulsion nozzles 19. Alternatively, a portion of the fluid can pass out of both.

The propulsion nozzles 19 have an interior profile which is smooth and without sharp corners, and in this way, the fluid exiting the propulsion nozzles 19 undergoes little turbulence, thereby improving the efficiency of the apparatus 1. Moreover, as can be seen from FIG. 3*a* in particular, the interior profile of each propulsion nozzle 19 is narrower at its exit than it is at its entrance. In this way, the fluid is further able to exit at a high speed thus generating optimum thrust.

Figure 1:
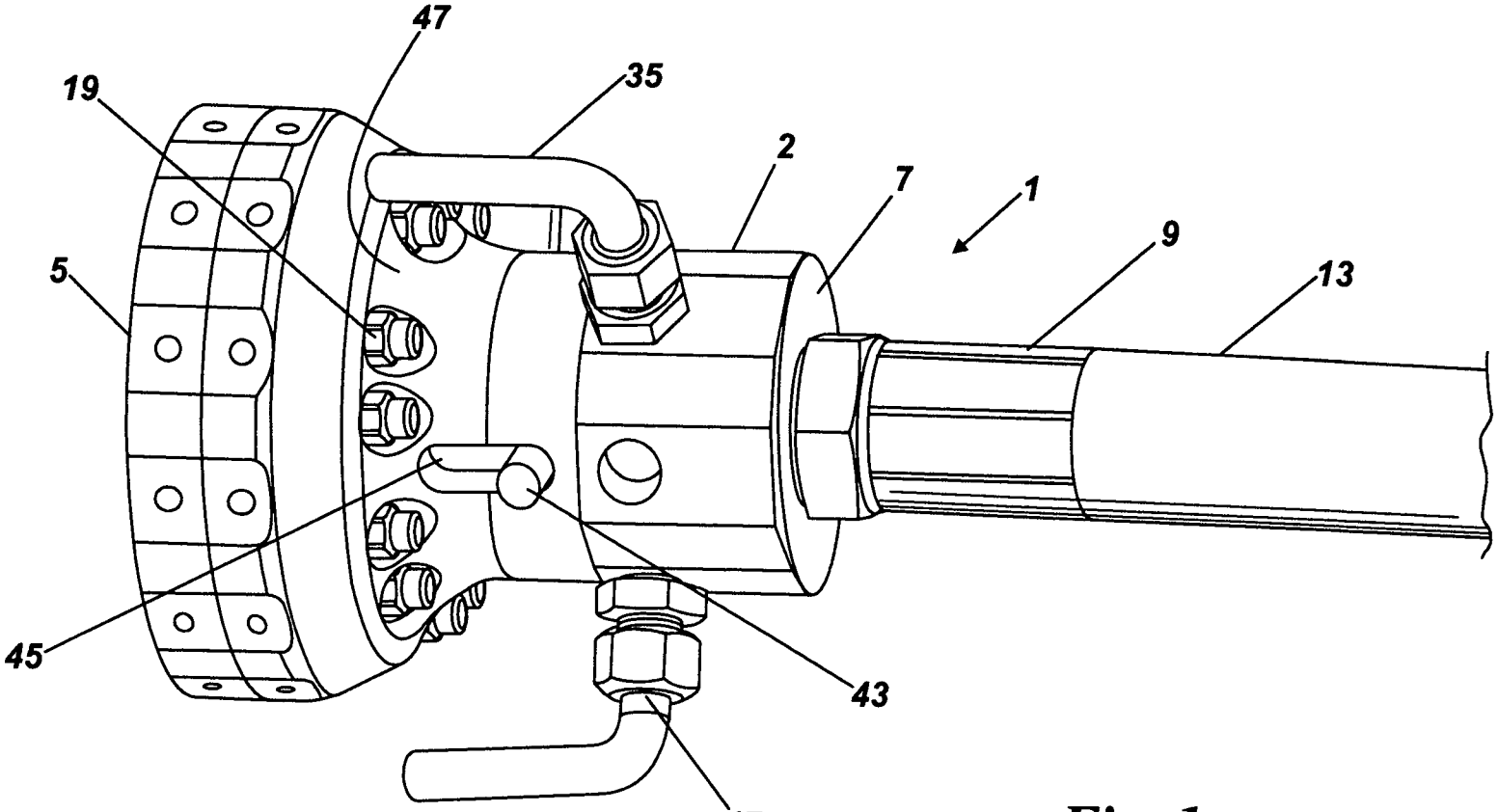
FIG. 1 shows a perspective view of a portion of an apparatus in accordance with a first embodiment of the present invention.
Figure 2:
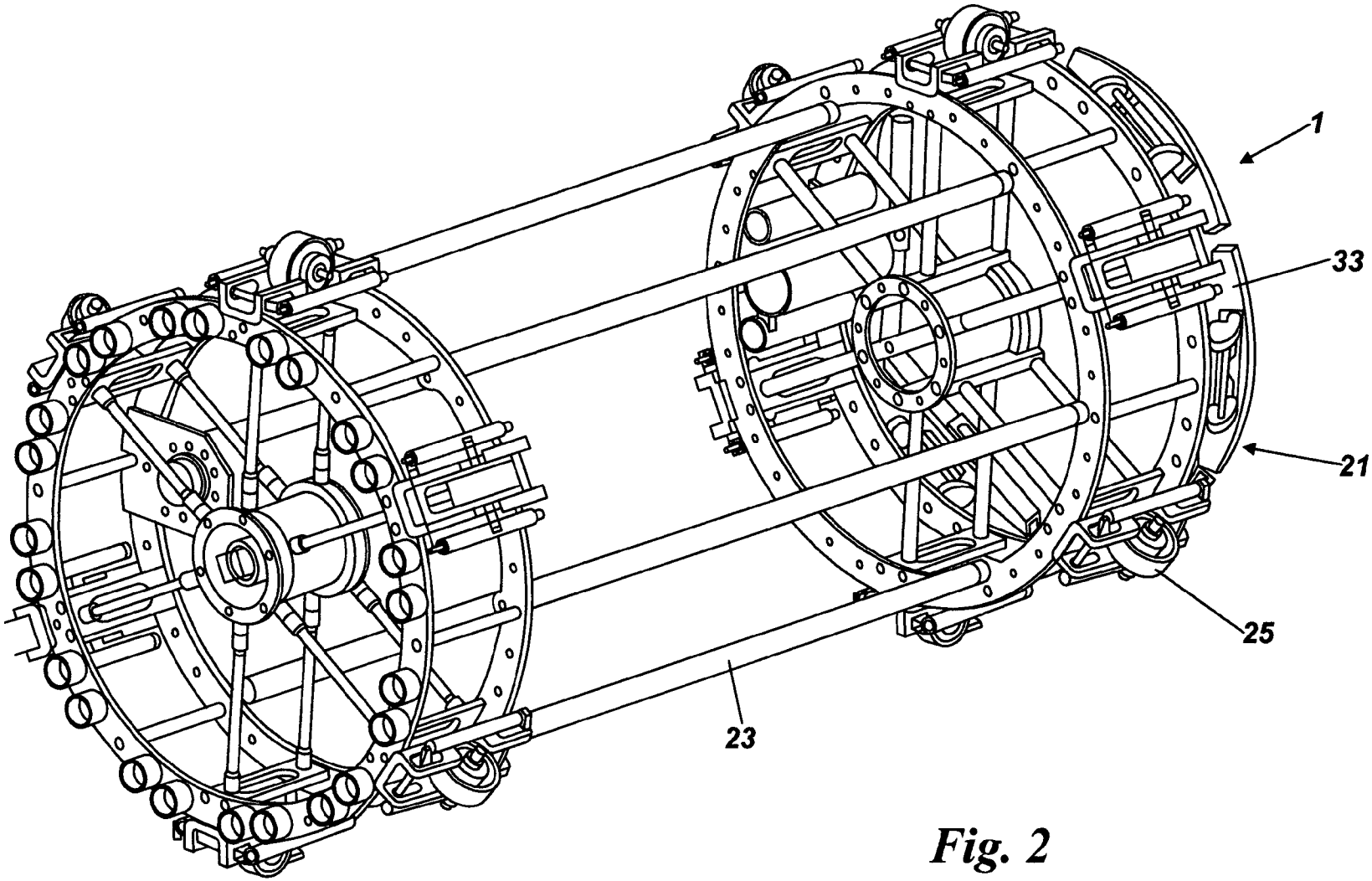
FIG. 2 shows a perspective view of a portion of an apparatus in accordance with a first embodiment of the present invention.

As can be seen from FIG. 2 in particular, the apparatus 1 further comprises a vehicle 21 on which the main body 2 is mounted. The vehicle 21 comprises a cylindrical framework comprising a plurality of elongate struts 23, along with a set of wheels 25. The main body 2 is supported within the open space T inside the cylindrical framework. The provision of the elongate struts 23 and the set of wheels 25 ensures that the apparatus 1 can easily move through the interior of the conduit both on the outbound and inbound journeys of the apparatus 1.

The apparatus 1 further comprises a support device 39, shown in FIG. 5, for the umbilical hose 9. The support device 39 reduces frictional forces between the umbilical hose 9 and the interior of the conduit as the apparatus 1 moves through the conduit. The support device 39 can take several forms; for example, a wheeled support vehicle into which the umbilical hose 9 can be clamped into as the apparatus 1 travels through the interior of the conduit. The support device 39 comprises a clamp comprising two half shell elements 41 hingedly connected together. In the event that it is required to support the umbilical hose 9 in the clamp, the two half shell elements 41 are opened and closed over the umbilical hose 9. In the event that fluid passes through the umbilical hose 9, the umbilical hose swells and thereby improves the clamping action of the half shell elements 41.

The vehicle 21 further comprises three cleaning manifolds 33. In the example illustrated up to six manifolds 33 may be accommodated. Each manifold 33 is an arcuate member having a manifold inlet (not shown) and six manifold outlets (not shown). Each manifold 33 may comprise as many or as few manifold outlets as are desirable. Each manifold inlet is connected to a cleaning nozzle 17 by means of a valved hose or channel (not shown). The manifolds 33 are able to be tilted as necessary, in order to alter the direction at which the fluid leaving the manifold outlets strikes the interior of the conduit.

Moreover, the manifold outlets are configured so that the fluid leaving the manifold outlets is in the form of a fan jet. It is to be appreciated that the manifold outlets can be configured so that they are able to be moved closer to or farther away from the pipe as required, in order to either improve the cleaning action or prevent damage to the pipe linings, respectively.

As can be clearly seen from FIGS. 3 and 4 in particular, the fluid path Z between the first open end 3 and the propulsion nozzles 19 includes a curvilinear portion M, as a result of the curvilinear profile of that part of the cavity A adjacent the second end 5 of the main body 2, the curvilinear profile of the collar 15, and the apex 51 in the main body 2. In particular, the curvilinear portion M ensures that the fluid leaving the propulsion nozzles 19 is turned through 180 degrees and in this way is diverted so that it flows in an opposite direction to the inward fluid flow, in order to propel the apparatus 1 through the interior of the conduit. It is to be appreciated that once the fluid has been turned through 180 degrees, the flow can be at zero degrees or five degrees for example, to the longitudinal axis, in order to provide the maximum thrust.

With the collar 15 in place however, dependent upon whether the collar 15 is in its first position (as shown in FIG. 3) or its second position (as shown in FIG. 4), the fluid is only able to exit the main body 2 via either the cleaning nozzles 17 or the propulsion nozzles 19 respectively, and not both.

To elaborate, as shown in FIG. 3, with the collar 15 in its first position, the fluid path Z between the first open end 3 of the main body 2 and the propulsion nozzles 19 is blocked by the presence of the collar 15 overlapping with the second fluid outlets of which the propulsion nozzles 19 form a part. However, a fluid path Y exists between the first open end 3 of the main body 2 and the cleaning nozzles 17.

Conversely, as shown in FIG. 4, with the collar 15 in its second position, the fluid path Y between the first open end 3 of the main body 2 and the cleaning nozzles 17 is blocked by the presence of the collar 15 overlapping with the first fluid outlets of which the cleaning nozzles 17 form a part. However, a fluid path Z exists between the first open end 3 of the main body 2 and the propulsion nozzles 19.

The operation of the apparatus 1 is as follows.

In the event that the interior of the conduit is to be cleaned, the apparatus 1 is located inside the conduit, and the second end 13 of the umbilical hose 9 is connected to a pressurised water supply at ground level. The collar 15 is then moved to its second position as shown in FIG. 4 (if it is not already in that position) whereby the cleaning nozzles 17 are blocked off but the propulsion nozzles 19 are not. The water supply is then switched on either automatically or by personnel at ground level and water at high pressure enters the apparatus 1 via the coupling means 7 and travels along second fluid path Z and out of the propulsion nozzles at high pressure and optimum efficiency. As a result of the configuration of the propulsion nozzles 19 and in particular their ability to direct the fluid flow rearwardly, the apparatus 1 is propelled along the interior of the conduit.

In the event that the apparatus 1 reaches the required position in the interior of the conduit, it is stopped upon manual operation of a suitable disabling means (not shown). Alternatively, the apparatus 1 is stopped naturally, in the event that the frictional force between the apparatus 1 and the interior of the conduit is equal and opposite to the propulsion force. The water supply is temporarily stopped, and then the collar 15 is moved from the second position to the first position, whereby the propulsion nozzles 19 are closed off but the cleaning nozzles 17 are not. The water supply is then switched on once again and water at high pressure enters the apparatus 1 via the coupling means 7 and travels along the first fluid path Y, through the cleaning nozzles 17, through the manifold inlet and then out of the manifold outlets at high pressure. The manifold outlets are arranged such that the water exiting at high pressure is directed towards the interior of the conduit to provide the requisite cleaning action. At the same time as the cleaning nozzles 17 are activated in this way, the apparatus 1 is pulled back to its original position in the interior of the conduit using for example, a winching device (not shown).

As well as providing a cleaning action utilizing the features as described above, the apparatus 1 is additionally equipped to facilitate the inspection of the interior of the conduit for imperfections such as cracks, and also to inspect how well the interior of the conduit has been cleaned. In this connection, the apparatus 1 further comprises an onboard digital camera (not shown) mounted to the main body 2. The digital camera is configured so that it is able to move around the periphery of the main body 2 in order to provide images of the whole of the interior of the conduit. The digital camera is coupled to an onboard flash memory (not shown), and in this way, as the apparatus 1 moves through the interior of the conduit, the digital camera is able to capture images of the interior of the conduit, which images are then stored in the onboard flash memory. As a result of this, the requirement for trailing electrical cables leading from the main body 2 to an observation station at ground level is obviated, and the apparatus 1 is able to travel through the interior of a conduit at a substantially higher speed than would otherwise be the case. To elaborate, if there was no onboard flash memory, then the apparatus 1 could only travel through the interior of a conduit at a speed slow enough to allow personnel to monitor the interior of the conduit in real time. However, with the onboard flash memory in place, the apparatus 1 is able to travel at much higher speeds, and the images can be viewed subsequently to the cleaning and inspection of the interior of the conduit, and post processed if necessary in order to provide the user with for example, a lay flat view of the interior of the conduit.

It is to be appreciated that the inspection of the interior of the conduit as described above could be carried out either before or after the cleaning process has been carried out, for example for comparison purposes.

It is also envisaged that the apparatus 1 could further include an illumination system (not shown) disposed upon the main body 2, to illuminate the interior of the conduit when necessary.

It is to be appreciated that the apparatus 1 further includes a spring biasing means (not shown) which biases the collar 15 in a direction such as to block the propulsion nozzles 19 under failure conditions; that is, the collar 15 is biased towards its first position. However, the apparatus 1 could be adapted so that the spring biasing means (not shown) biases the collar 15 towards its second position.

Referring now to FIGS. 6 to 8, a second embodiment of an apparatus for controlling the flow of fluid through the interior of a conduit is represented generally by reference numeral 101.

The apparatus 101 is similar to the first embodiment, comprising a main body 102 having a first open end 103 and a second end 105. The apparatus 101 further comprises a fluid inlet 107 which is connectable to a water supply for example, via an umbilical hose (not shown in this embodiment). As can be clearly seen from the Figures, the main body 102 includes a bore in the form of a cavity A' disposed between the first open end 103 and the second end 105, inside of which is disposed a movable element 115.

The movable element 115 differs from that shown in the previous embodiment in that it is rotatable about the longitudinal axis S of the apparatus 101, as opposed to being slidable along the longitudinal axis S as is the case with the embodiment shown in FIGS. 1 to 5.

As can be clearly seen from the Figures, the exterior surface of the main body 102 comprises a stepped portion 156 between the first open end 103 and the second end 105. In this embodiment, a plurality of cleaning nozzles 117 and propulsion nozzles 119 are alternately disposed around the stepped portion 156, such that there are two propulsion nozzles 119 disposed directly adjacent each cleaning nozzle 117 and vice versa.

The movable element 115 is disposed within the cavity A' and is shown in more detail in FIGS. 6 and 6*a*. The element 115 is generally disk shaped and is comprised of two constituent parts 151 and 153. The first constituent part 151 of the movable element 115 is shown in particular in FIG. 6 and is comprised of a circular body 150 having an apex 157 and a curvilinear portion 152 arranged towards its centre. The first constituent part 151 further comprises a plurality of apertures 154 for receiving bolts (not shown) for example, for attaching the constituent parts 151 and 153 together. The purpose of the curvilinear portion 152 is to direct fluid through each of a plurality of further apertures 155, as will be explained in further detail below.

The movable element 115 is rotatable about the longitudinal axis S between a first condition as shown in FIG. 7, in which a fluid path exists between the fluid inlet 107 and the cleaning nozzles 117 and no fluid path exists between the fluid inlet 107 and the propulsion nozzles 119, and a second condition as shown in FIG. 8 in which a fluid path exists between the fluid inlet 107 and the propulsion nozzles 119 and no fluid path exists between the fluid inlet 107 and the cleaning nozzles 117.

It can be clearly seen from the Figures that the movable element 115 is configured to activate the nozzles 119 and 117 respectively in this way, on account of the plurality of further apertures 154 disposed around the periphery of the circular body 150 and the plurality of blanks 158 disposed therebetween.

It is to be appreciated that when the movable element 115 is in its first position, each further aperture 154 is aligned with a cleaning nozzle 117 and each blank 158 is aligned with a propulsion nozzle 119. In this way, in the event that fluid enters the apparatus 101 via the fluid inlet 107, it is expelled via the cleaning nozzles 117 in order to remove debris from the interior of a conduit. Conversely, when the movable element 115 is in its second position, each further aperture 154 is aligned with a propulsion nozzle 119 and each blank 158 is aligned with a cleaning nozzle 117. In this way, in the event that fluid enters the apparatus 101 via the fluid inlet 107, it is expelled via the propulsion nozzles 119 in order to propel the apparatus 101 through the interior of a conduit.

It is to be appreciated that the curvilinear portion 152 serves to reduce the turbulence in the fluid flow and improve the efficiency of the apparatus as a whole on account of there being no sharp corners as the fluid is diverted through the various nozzles.

Referring now to FIGS. 9 and 10, a third embodiment of an apparatus for controlling the flow of fluid through the interior of a conduit is represented generally by reference numeral 201.

The apparatus 201 is similar to the second embodiment, comprising a main body 202 including a bore in the form of a cavity A". The main body 202 has a first open end 203 and a second end 205, and it can be clearly seen from the Figures that cavity A" is disposed between the first open end 203 and the second end 205.

The apparatus 201 further comprises a fluid inlet 207 which is connectable to a water supply for example, via an umbilical hose (not shown in this embodiment).

In this embodiment, the movable element 215 is not disposed within the cavity A" as is the case with the previous embodiments, but is instead disposed around a stepped portion 256 of the exterior surface of the main body 202 and is disposed between the first open end 203 and the second end 205. The movable element 215 is generally disk shaped, being comprised of a circular body 250 having an aperture 252 through its centre to facilitate its location around the stepped portion 256.

In this embodiment, a plurality of cleaning nozzles 217 and propulsion nozzles 219 are alternately disposed around the circular body 250, such that there are two propulsion nozzles 219 disposed directly adjacent each cleaning nozzle 217 and vice versa.

As with the second embodiment shown in FIGS. 6 to 8, the movable element 215 is rotatable about the longitudinal axis S of the apparatus 201, as opposed to being slidable along the longitudinal axis S as is the case with the first embodiment shown in FIGS. 1 to 5.

In particular, the movable element 215 is rotatable about the longitudinal axis S between a first condition as shown in FIG. 9, in which a fluid path exists between the fluid inlet 207 and the cleaning nozzles 217 and no fluid path exists between the fluid inlet 207 and propulsion nozzles 219, and a second condition as shown in FIG. 10 in which a fluid path exists between the fluid inlet 207 and the propulsion nozzles 219 and no fluid path exists between the fluid inlet 207 and the cleaning nozzles 217.

It is to be appreciated that when the element 215 is in its first condition, each first fluid outlet 260 is aligned with a cleaning nozzle 217 and each propulsion nozzle 219 is aligned with a blank (not shown) disposed on the circular body 250. In this way, in the event that fluid enters the apparatus 201 via the fluid inlet 207, it is expelled via the cleaning nozzles 217 in order to remove debris from the interior of the conduit.

Conversely, when the element 215 is in its second condition, each first fluid outlet 260 is aligned with a propulsion nozzle 219 and each blank is aligned with a cleaning nozzle 217. In this way, in the event that fluid enters the apparatus 201 via the fluid inlet 207, it is expelled via the propulsion nozzles 219 in order to propel the apparatus 201 through the interior of the conduit.

It is to be appreciated that the main body 202 and in particular the cavity A" comprises a curvilinear interior portion 290 which serves to deflect the fluid flow through 180 degrees as it passes through the main body 202.

Referring now to FIGS. 11 and 12, a fourth embodiment of an apparatus for controlling the flow of fluid through the interior of a conduit is represented generally by reference numeral 301.

The apparatus 301 is identical to the embodiment of FIGS. 1 to 5 but for the configuration of actuator pins 343, which will be described in further detail below. In particular, the apparatus 301 comprises a main body 302 having a bore in the form of a cavity A, and a movable control element in the form of a collar 315 disposed within the cavity A. The main body 302 has a first open end 303 and a second end 305.

The apparatus 301 further comprises a fluid inlet in the form of a coupling means 307 for coupling the first open end 303 to a source of fluid, for example, a water supply (not shown). The apparatus 301 further comprises an umbilical hose 309 which is connected at one end 311 to the coupling means 307 and at an opposite end 313 to the water supply.

The collar 315 comprises three actuator pins 343, each pin 343 extending through a corresponding aperture 345 in the main body 2, to facilitate the movement of the collar 315 between its first and second positions. It is to be appreciated that the presence of several pins 343 in this way as opposed to only a single pin 343 facilitates smoother actuation. It is envisaged that the collar 315 could be moved either manually, or by means of a fluid based system such as an air pressure operated system, an oil pressure operated system, or a water pressure operated system. Alternatively, the collar 315 could be moved electronically, for example by means of an electric motor.

The apparatus 301 further comprises a circumferential seal (not shown) disposed between the collar 315 and the main body 302. The main body 302 also includes three first fluid outlets in the form of three take off cleaning nozzles 317 disposed around the periphery of the main body 302, and a plurality of second fluid outlets in the form of twelve propulsion nozzles 319 disposed around the periphery of the main body 302.

As with the embodiment of FIGS. 1 to 5, the propulsion nozzles 319 have an interior profile which is smooth and without sharp corners, and in this way, the fluid exiting the propulsion nozzles 319 undergoes little turbulence, thereby improving the efficiency of the apparatus 301.

The apparatus 301 differs from that of FIGS. 1 to 5 in that a plurality of flexible membranes 321 are additionally provided, which cover each of the actuator pins 343.

Each flexible membrane 321 is attached around its periphery 323 to the exterior wall of the main body 302 and provides a seal against the ingress of dirt into the apparatus 301 through the aperture 345 in the main body. The flexible nature of each membrane 321 ensures that it remains attached to the main body 302 even in the event that the actuator pin 343 is moved between its two positions.

It is to be appreciated however, that the apparatus 301 could alternatively comprise a single flexible membrane (not shown) extending around the periphery of the main body 302, which covers each of the actuator pins 343, as opposed to a plurality of discrete flexible membranes 321.

Referring now to FIG. 13, a fifth embodiment of an apparatus for controlling the flow of fluid through the interior of a conduit is represented generally by reference numeral 401.

The apparatus 401 is identical to the embodiment of FIGS. 1 to 5 but for the configuration of the actuator pins 443, which will be described in further detail below.

Each actuator pin 443 comprises an internal bore 490 which provides a fluid path from the interior A of the main body 402 to approximately mid way through the interior of the actuator pin 443. The internal bore 490 then bifurcates into two exit bores 492 and 494 which provide a fluid path from the end 491 of the internal bore 490 to the exterior of the apparatus 401. The exit bores 492 and 494 are disposed at a transverse angle P to the longitudinal axis L of the actuator pin 443, where P is for example thirty degrees. The reason for this configuration of the actuator pin 443 is to provide a means for harnessing a small portion of the fluid pressure inside the main body 402 and using it to wash the aperture 445. To elaborate, in the event that fluid flows under pressure through the main body 402, a small portion thereof escapes through the exit bores 492 and 494 and applies a small jet of water to the aperture 445, which effectively cleans the aperture of any deposits which could otherwise make their way into the interior of the apparatus 401 and potentially inhibit the performance of the apparatus 401.

It is to be appreciated that the size of the bores 490, 492 and 494 are such that the volume of fluid that is harnessed from the interior of the main body 402 is not so high that the pressure inside the main body 402 is significantly reduced but instead is just enough to provide a rinsing action on the aperture 445.

Referring now to FIG. 14, a sixth embodiment of an apparatus for controlling the flow of fluid through the interior of a conduit is represented generally by reference numeral 501.

The apparatus 501 is identical to the embodiment of FIGS. 1 to 5 but for the presence of tap-off bores 596 on the main body 502, which will be explained in further detail below.

The main body 502 comprises a plurality of tap-off bores 596 disposed at intervals around the periphery thereof. Each tap-off bore 596 provides a fluid path from the interior of the main body 502 to the exterior of the main body 502. The apparatus 501 further comprises a plurality of nozzles (not shown) each one connected to a tap-off bore 596, and arranged to direct fluid towards a location in the region of the aperture 545, each nozzle being in fluid communication with a tap-off bore 596, for example by means of a conduit The reason for this configuration is to provide a means for harnessing a small portion of the fluid pressure inside the main body 502 and using it to clean the aperture 545. To elaborate, in the event that fluid flows under pressure through the main body 502, a small portion thereof escapes through each tap-off bore 596, travels through the associated nozzle and applies a small jet of water to the aperture 545, which effectively cleans the aperture 545 of any deposits which could otherwise make their way into the interior of the apparatus 501 and potentially inhibit the performance of the apparatus 501.

It is to be appreciated that the location of the tap-off bores 596 on the main body 502 is such that they are not covered over by the collar in either of its two positions. As such, the tap-off bores 596 always provide a fluid path from the interior of the main body 502 to the exterior of the main body 502.

Referring now to FIG. 15, a seventh embodiment of an apparatus for controlling the flow of fluid through the interior of a conduit is represented generally by reference numeral 601.

The apparatus 601 is similar to the embodiment shown in FIGS. 1 to 5 and comprises a main body 602 including a bore in the form of a cavity A. The main body 602 has a first open end 603 and a second end 605. A control element in the form of a collar 615 is disposed inside the cavity A. The apparatus 601 further comprises a fluid inlet in the form of a coupling means 607 for coupling the first open end 603 to a source of fluid, for example, a water supply (not shown). The apparatus 601 further comprises an umbilical hose 609 which is connected at one end 611 to the coupling means 607 and at an opposite end 613 to the water supply.

The collar 615 comprises six actuator pins 643, each pin 643 extending through a corresponding aperture 645 in the main body 602, to facilitate the movement of the collar 615 between its first and second positions. It is to be appreciated that the presence of several pins 643 in this way as opposed to only a single pin 643 facilitates smoother actuation. It is envisaged that the collar 615 could be moved either by means of a fluid based system such as an air pressure operated system, an oil pressure operated system, or a water pressure operated system.

The main body 602 also includes six first fluid outlets in the form of six take off cleaning nozzles 617 disposed around the periphery of the main body 602, and a plurality of second fluid outlets in the form of twelve propulsion nozzles 619 disposed around the periphery of the main body 602.

The apparatus 601 further comprises three O-ring seals (not shown) disposed between the collar 615 and the main body 602. The presence of the O-ring seals results in the formation of a small circumferential gap 616 between the collar 615 and the main body 602, extending around the periphery of the main body 602. The collar 615 includes a plurality of small bores 621 providing a fluid path between the interior of the main body 602 and the gap 616. As a result of the small bores 621, in the event that fluid flows under pressure through the main body 602, a small portion thereof escapes through each small bore 621 and fills the gap 616 with fluid. Once the gap 616 has filled with fluid from the main body 602, the fluid pressure inside the main body 602 causes the fluid in the gap 616 to bleed through the gap 616 and into the region of the aperture 645. The presence of this positive internal pressure inside the main body 602 prevents the passage of debris for example, from the outside of the main body 602 via the aperture 645 into the cavity A.

Referring now to FIGS. 16 and 17, an eighth embodiment of an apparatus for controlling the flow of fluid through the interior of a conduit is represented generally by reference numeral 701.

The apparatus 701 is similar to the embodiment shown in FIGS. 1 to 5 and comprises a main body 702 including a bore in the form of a cavity A. The main body 702 has a first open end 703 and a second end 705. A control element in the form of a collar 715 is disposed inside the cavity A. The apparatus 701 further comprises a fluid inlet in the form of a coupling means 707 for coupling the first open end 703 to a source of fluid, for example, a water supply (not shown). The apparatus 701 further comprises an umbilical hose 709 which is connected at one end 711 to the coupling means 707 and at an opposite end 713 to the water supply.

The main body 702 also includes six first fluid outlets in the form of six take off cleaning nozzles 717 disposed around the periphery of the main body 702, and a plurality of second fluid outlets in the form of twelve propulsion nozzles 719 disposed around the periphery of the main body 702.

The apparatus 701 differs from the previous embodiments in that the collar 715 does not comprise any actuator pins in order to facilitate the movement of the collar 715 between its first and second positions. Instead, the apparatus 701 comprises an actuator shaft 770 disposed towards the rear of the main body 702. The actuator shaft 770 is arranged so that it is co-linear with the longitudinal axis Q of the apparatus 701. The actuator shaft 770 is retained within a bore 772 in the main body 702 and has a first end 773 disposed outside of the main body 702 and a second end 774 disposed inside the cavity A in the main body 702.

The actuator shaft 770 comprises hydrofoil shaped fins 776 which are disposed towards the second end 774 thereof. The fins 776 are attached at their distal ends to the interior of the collar 715. Although the fins 776 are disposed in the cavity A and as such are disposed in the fluid stream, they are shaped so that they produce only minimal resistance to the flow of fluid. The actuator shaft 770 is able to move through the bore 772 in the main body 702 in a direction parallel to the longitudinal axis Q. In view of the attachment of the fins 776 to the interior of the collar 715, in the event that the actuator shaft 770 is moved along the longitudinal axis Q, the collar 715 moves along with it. In this way, the collar is able to be moved between its first and second positions by means of moving the actuator shaft 770.

The apparatus 701 further comprises a seal (not shown) between the actuator shaft 770 and the main body 702, which prevents the escape of fluid from the cavity A through the bore 772 in the main body 702.

The actuator shaft 770 may be moved along the longitudinal axis Q by any suitable means, for example by means of a fluid based system which could take the form of an electrically operated system, an air pressure operated system, an oil pressure operated system, or a water pressure operated system.

Referring now to FIGS. 18 and 19, a ninth embodiment of an apparatus for controlling the flow of fluid through the interior of a conduit is represented generally by reference numeral 801. The apparatus 801 is identical to the embodiment shown in FIGS. 1 to 5 but for the additional presence of a channel 871 in collar 815, and an associated trapezoidal seal 871*a* disposed within the channel 871. The channel 871 runs around the periphery of the collar and as can be clearly seen from FIGS. 18 and 19, is trapezoidal in cross-section. The trapezoidal seal 871*a* is of a suitable size and shape so that it locates inside the trapezoidal channel 871 and is retained therein. In the event that the collar 815 is in its first position, as shown in FIG. 18, the trapezoidal seal 871*a* forms a seal between the collar 815 and main body 802, which prevents any fluid in the cavity A from escaping through propulsion nozzles 819. This provides the advantage that the efficiency of the apparatus 801 is improved since substantially all of the fluid is expelled through cleaning nozzles 817 when the collar 815 is in its first condition.

The seal 871*a* and the channel 871 are trapezoidal in the illustrated example. However, the seal 871*a* and the channel 871 may be of any suitable cross-section shape, for example but not limited to: circular, oval, polygonal, quadrilateral, rectangular.

The seal 871*a* may or may not have peripheral projections.

It will be appreciated by persons skilled in the art that the above embodiments have been described by way of example only, and not in any limitative sense, and that various alterations and modifications are possible without departing from the scope of the invention as defined by the appended claims.

The invention claimed is:

1. An apparatus for controlling the flow of fluid in a conduit, the apparatus comprising:

(I) a main body including a bore, having a first, rearward open end and a second, forward end;

(ii) a fluid inlet for coupling said first open end of said main body to a source of fluid, such that said fluid flows in a forward direction into said bore from said fluid inlet;

(iii) at least one first fluid outlet adapted to direct at least a portion of the fluid entering said bore via said fluid inlet in a first direction; and (iv) at least one second fluid outlet adapted to direct at least a portion of the fluid entering said bore via said fluid inlet in a rearward direction so as to propel said apparatus through the interior of the conduit;

(v) a control element moveably located in said bore between (a) a first position in which a first fluid path exists between said fluid inlet and at least one said first fluid outlet; and (b) a second position in which a second fluid path exists between said fluid inlet and at least one said second fluid outlet;

wherein said bore is shaped so that said second fluid path is curvilinear to direct the flow of fluid from its forward direction to a rearward direction while minimizing turbulence; and at least one actuator for moving the control element between said first and second positions, wherein at least one said actuator comprises an actuator pin extending from said collar and extending through an aperture disposed on said main body and extending out of said main body.

* * * * *